US007316895B2

(12) United States Patent
Teranishi et al.

(10) Patent No.: US 7,316,895 B2
(45) Date of Patent: Jan. 8, 2008

(54) METHOD FOR PRECIPITATING SEPARATION OF PHOTOSENSITIVE SILVER HALIDE PARTICLE DISPERSION AND SILVER SALT PHOTOTHERMOGRAPHIC DRY IMAGING MATERIAL USING THEREOF

(75) Inventors: Miyuki Teranishi, Tokyo (JP); Hiroto Ito, Tokyo (JP)

(73) Assignee: Konica Minolta Medical & Graphic Inc., Tokyo (JP)

( * ) Notice: Subject to any disclaimer, the term of this patent is extended or adjusted under 35 U.S.C. 154(b) by 0 days.

(21) Appl. No.: 11/558,609

(22) Filed: Nov. 10, 2006

(65) Prior Publication Data

US 2007/0117052 A1 May 24, 2007

(30) Foreign Application Priority Data

Nov. 22, 2005 (JP) ..... 2005-336786

(51) Int. Cl.

| | |
|---|---|
| ***G03C 5/18*** | (2006.01) |
| ***G03C 5/26*** | (2006.01) |
| ***G03C 1/00*** | (2006.01) |
| ***G03C 1/005*** | (2006.01) |
| ***G03C 1/494*** | (2006.01) |

(52) U.S. Cl. ..... 430/449; 430/617; 430/546; 430/567; 430/627; 430/631; 430/569

(58) Field of Classification Search ..... 430/449, 430/617, 546, 567, 627, 631, 569
See application file for complete search history.

(56) References Cited

U.S. PATENT DOCUMENTS

| | | | | |
|---|---|---|---|---|
| 7,022,470 | B2 * | 4/2006 | Fukusaka et al. | 430/617 |
| 2006/0099539 | A1 * | 5/2006 | Ito et al. | 430/567 |

* cited by examiner

*Primary Examiner*—Geraldina Visconti
(74) *Attorney, Agent, or Firm*—Lucas & Mercanti, LLP

(57) ABSTRACT

A method for separating photosensitive silver halide particles by precipitation from a dispersion comprising the silver halide particles and a protective colloid of a natural polymer, the method comprising the step of mixing the dispersion with an organic polymer having a logarithm value of n-octanol/water partition coefficient (being a log P value) of 0.8 to 2.0 so as to separate the silver halide particles from the dispersion.

6 Claims, No Drawings

METHOD FOR PRECIPITATING SEPARATION OF PHOTOSENSITIVE SILVER HALIDE PARTICLE DISPERSION AND SILVER SALT PHOTOTHERMOGRAPHIC DRY IMAGING MATERIAL USING THEREOF

This application is based on Japanese Patent Application No. 2005-336786 filed on Nov. 22, 2005, in Japanese Patent Office, the entire content of which is hereby incorporated by reference.

1. Field of the Invention

The present invention relates to a method of precipitating separation of silver halide particles from a dispersion of photosensitive silver halide particle, a photosensitive emulsion using silver halide particles separated by such a method, and a silver salt photothermographic dry imaging material using the same.

2. Technical Background

Recently, image forming components which entirely satisfy safety and ecological protection, additionally to properties such as sensitometric characteristics, image characteristics and handling simplicity. Especially, needed is the change from wet-processing to dry-processing, and is often raised in the medical and printing fields since dumping of the exhausted liquids of photographic processing solutions into the sea is generally prohibited.

Recently, in the medical field, medical diagnosis images are primarily prepared by a MRI (magnetic resonance imaging), CT (computed tomography) or CR (computed radiography) accompanied with digitalization of medical data, and various kinds of dry-imaging systems have been applied for outputting these medical images. In the field of printing, digitalization and the spreading of dry-processing have similarly progressed.

Based on such social and economical background, the importance of photothermographic material is increased by which a high resolution and clear image can be formed by highly efficient light exposing apparatus such as a laser imager and an image setter, but further improvement of such the imaging material continues.

As a technology regarding the photothermographic dry imaging material, a silver salt photothermographic material containing a support, a photo-insensitive organic silver salt, a photosensitive silver halide particle and a silver ion reducing agent is known which is described in, for example, U.S. Pat. Nos. 3,152,904 and 3,487,075 by D. Morgan and B. Shely, and D. H. Klosterboer, "Dry Silver Photographic Material" ("Handbook of Imaging Materials", Marc Dekker, Inc. 1991). Such silver salt photothermographic dry imaging material exhibits the advantage such as that a system can be provided which is simpler and does not cause any damage to the environment because absolutely no chemical processing is used.

The silver salt photothermographic imaging material is characterized in that the photosensitive silver halide particle functions as a photo-sensor and the organic silver salt functions as a silver ion source, and the silver ion is reduced by the reducing agent contained in the material during thermal development at a temperature of from 80 to 140° C. to form an image without any need of fixing.

The silver halide particles used as the photosensing substance in the foregoing silver salt photothermographic dry imaging material, particularly in that produced by an organic solvent coating system, are very fine particles having an average particle diameter of about 50 nm. In the emulsion, a hydrophilic natural high molecular dispersing agent such as gelatin is frequently used as a protective colloid. However a problem is caused in the production of the silver salt photothermographic material in that the silver halide particles undesirably aggregate or grow or ripen upon contact of the particles with the organic solvent.

However, it is in the present condition that many usual techniques such as that for forming silver halide particles using an aqueous medium, chemical sensitizing the silver halide particles by a water-soluble sensitizer, and storing the silver halide emulsion utilizing the gelation of gelatin are superior and show merit by the use of gelatin, and the problem of aggregation of particles in the organic solvent system is compromised to some degree during practice.

For improving the aggregation of the silver halide particles, the silver halide particles are added in the process of formation of organic silver salt to be contained in the silver salt photothermographic dry imaging material. Aggregation is mitigated when the long chain fatty acid is applied as the dispersing agent in such a process. In such method, however, the dispersion of the silver halide particles is insufficient and fogging is increased which is a major drawback of the silver salt photothermographic dry imaging material because the mixing system contains organic silver salt. Thus these problems have not been solved in the present status.

Hitherto, the aqueous dispersion of silver halide particles occurs during preparation of the silver fatty acid salt, and the loss (lowering of maximum density) of the color forming point caused by ripening and aggregation of the silver halide particles, and the increase in fogging during development and storage caused by an increase in contact probability with the fatty acid silver salt are major concerns.

In addition, the advantages of an ultra-fine particle of nano order size, so called nano-fine particle, is called for in various industrial fields, and technology for dispersing the nano-fine particles is considered as being important. In such fields, difficulty of the technique to stably disperse inorganic particles such as minute silver halide particles in an organic solvent is high at the present. It is thought that the inorganic particles are barely dispersed in the organic solvent system because the surface of the inorganic particle is hydrophilic.

To overcome such problem, a method is disclosed in which a hydrophobic dispersing agent is provided as a protective colloid onto the surface of the inorganic particle via chemical bonding, cf. Patent Document 1, for example. Patent Document 1, however, does not describe nor suggest at all any technique for dispersing minute particles in the organic solvent system by applying a hydrophobic dispersing agent onto the hydrophilic protective colloid particle dispersable an aqueous system.

Moreover, techniques for dispersing in an amphipathic dispersion system are disclosed, in which a thermo-sensitive polymer capable of reversibly changing in hydrophilicity/hydrophobicity at the threshold of the phase transition temperature of the polymer as the dispersing agent, cf. Patent Document 2. In the method disclosed in Patent Document 2, however, a problem is posed in that the variation of modification in the aqueous system and organic solvent system is greatly limited since the hydrophilicity and hydrophobicity of the dispersing polymer is thermally reversible.

Patent Document 1: Unexamined Japanese Patent Application Publication No. (hereinafter, referred to as JP-A) 5-111631

Patent Document 2: JP-A 7-276792

SUMMARY OF THE INVENTION

The invention was achieved based on the above background, and an object of it is to solve the problems such as the aggregation of the silver halide particles occurring in the organic solvent system while keeping the advantages of the usual photosensitive silver halide particle using the protective colloid of natural polymer such as gelatin, and to provide a production method of a photosensitive emulsion and a silver salt photothermographic dry imaging material which exhibits low fogging, high image density, high sensitivity and superior storage stability.

The object of this invention can be attained by the following constitution.

1. A method for separating photosensitive silver halide particles by precipitation from a dispersion comprising the silver halide particles and a protective colloid of a natural polymer, the method comprising the step of:

mixing the dispersion with an organic polymer having a logarithm value of n-octanol/water partition coefficient (being a log P value) of 0.8-2.0 so as to separate the silver halide particles from the dispersion.

2. The method for separating by precipitation of above Item 1, wherein the method further comprising the step of:

controlling a temperature of the dispersion after mixed with the organic polymer to 15-30° C.

3. The method for separating by precipitation of above Item 1 or 2, wherein a solid content of a supernatant liquid of the separated system is not more than 15% of the entire solid components of the dispersion.

4. A precipitate obtained by the method described in any one of above Items 1-3.

5. A photosensitive emulsion produced by mixing an organic solvent with a photosensitive silver halide particle dispersion obtained by dispersing the precipitate described in above Item 4 into an organic solvent having a water content of not more than 10%.

6. A silver salt photothermographic dry imaging material comprising a support and a photosensitive layer containing the photosensitive emulsion described in Item 5 provided on the support.

[Effects of the Invention]

By the above constitution of this invention, the problem of such as the aggregation of the silver halide particles caused in the organic solvent system can be solved while keeping the advantages of the usual photosensitive silver halide particles using a protective colloid of a natural polymer such as gelatin, and a production method of a photosensitive emulsion and a silver salt photothermographic dry imaging material can be provided which exhibits low fogging, high image density, high sensitivity and superior storage stability.

THE BEST EMBODIMENT FOR PRACTICING THE INVENTION

The invention and the constituting matters of the invention are described below.

<<Method for Separating Photosensitive Silver Halide Particles from the Dispersion Thereof by Precipitation>>

The method for separating the photosensitive silver halide dispersion by precipitation according to this invention is a method for separating the photosensitive silver halide particle dispersion using a natural polymer such as a protective colloid, and is characterized in that the separation is carried out by adding and mixing the organic polymer having a log P value of 0.8-2.0 with the dispersion. It is assumed that the reactivity of the organic polymer with the silver halide particle is raised by making the log P value of the organic polymer to be at most 2.0 and the particle can be made more hydrophobic so as to be easily precipitated by making the log P value to be at least 0.8.

In the precipitating separation method of this invention, it is preferably carried out by lowering the temperature of the photosensitive silver halide particle dispersion. For example, the temperature of the silver halide particle dispersion during the preparation thereof (40 to 50° C.) is preferably lowered to a temperature of 15-30 ° C. It is assumed that the precipitation can be more easily carried out by shortening the moving distance of Brownian motion of the particles by lowering the temperature.

Further, it is preferable that the solid content of the supernatant after separation is at most 15% of the entire solid components. The silver halide particles can be recovered with high efficiency and the influence on the environmental condition by the exhausted supernatant can be reduced by keeping the solid content within the range of the above limitation.

Natural Polymer as Protective Colloid

There is no limitation as to a natural polymer usable in this invention, for example, a protein such as gelatin and its derivatives, a graft polymer of gelatin with another polymer, albumin or casein; and a sugar derivative such as sodium alginate or a starch derivative are usable. In this invention, gelatin is preferably applied from the viewpoint of prevention of aggregation of silver halide particles. As a result of that, the particles can uniformly be dispersed and the developed silver can finally be controlled to the desired shape. Moreover, a chemically modified gelatin modified as a hydrophilic group of gelatin, such as an amino group and a carboxyl group, is more preferable.

As mentioned above, the use of a chemically modified gelatin is preferable in this invention. The "chemically modified gelatin" is a gelatin modified by a compound capable of reacting with a reactive group in gelatin such as a —C(═O)— group, an —NH— group, an —N═ atom, an —N< atom, an —O— atom, an —S— atom, an —NH—C(═$NH_2^+$)NH— group or an —NH—C(═NH)NH— group.

For modification of the amino group in the gelatin molecule, for example, phenylcarbamoylation, phthalation, succination, acetylation, benzoylation and nitrophenylation are applicable, while modification of the carboxylic group, methyl esterization and amidization are applicable.

In this invention, a gelatin is preferably used in which a suitable number of amino groups among the amino groups being in the gelatin molecule is chemically modified.

The chemically modified gelatin of the amino groups is described in detail below.

As the —$NH_2$ group in gelatin, an amino group at the terminal of the gelatin molecule, that of a lysinyl group, hydroxylysinyl group, histidinyl group or an argininyl group, and that of an ornithinyl group when the argininyl group is substituted by the ornithinyl group, are applicable. An impurity group such as an adeninyl group and a guaninyl group are also can be cited.

Chemical modification of the amino group is carried out by adding a reactive agent to gelatin to react with the amino group so as to form a covalent bond or to deaminate it. Namely, the primary amino group (—$NH_2$) is changed to a secondary amino group (—NH—), a tertiary amino group or a deaminated compound.

Specifically, the modification can be carried out by adding and reacting one of the following compounds, for example, an acid anhydride such as maleic anhydride, o-phthalic anhydride, succinic anhydride, isatic anhydride and benzoic anhydride; an acid halide such as R—COX, R—$SO_2$X, R—O—COX and phenyl-COCl; a compound having an aldehyde group such as R—CHO; a compound having an epoxy group; a deaminating agent such as $HNO_2$ and deaminase; a reactive ester compound such as a sulfonate, p-nitrophenyl acetate, isopropenyl acetate, methyl o-chlorobenzoate and p-nitrophenyl benzoate; an isocyanate compound such as an arylisocyanate; a reactive halogen compound such as an aryl halide (benzyl bromide, a biphenylhalomethane, benzoylhalomethane and phenylbenzoylhalomethane and 1-fluoro-2,4-dinitrobenzene), a β-ketohalide, an α-halofatty acid, a β-halonitrile and a halogen derivative of s-triazine, pyrimidine, pyridazine, pyrazine, pyridazone, quinoxaline, quinazoline, phthalazine, benzoxazole, benzothiazole or benzimidazole; a carbamoylizating agent such as a cyanate and nitrourea; a compound having an acryl type reactive double bond such as maleimide, acrylamine, acrylamide, acrylonitrile, methyl methacrylate, vinylsulfone, a vinylsulfonate, sulfonamide, styrene, vinylpyridine, acrylamine, butadiene, isoprene and chloroprene; a sultone such as butanesultone and propanesultone; a guanidizing agent such as o-methylisourea; ditiocarbamilating agent such as 4-(N,N-diethyl-dithiocarbamyl) benzoate; and a carboxyl azide.

In such a case, a reagent capable of reacting principally with the —$NH_2$ group of gelatin is preferable rather than a reagent capable of also reacting with a —OH group and a —COOH group of gelatin. "Principally" means at least 60%, preferably 80-100% and more preferably 95-100%.

Further, it is preferable that the reaction product contains substantially no group in which the ether bond or oxygen atom of the ketone group is replaced by a charcogen atom such as an —S— or a thione group. "Contains substantially no" means that the ratio of the group substituted for such a group is at most 10% and preferably 0-3%. Accordingly, an acid anhydride, a sultone compound, a compound having a reactive double bond, a carbamoylizing agent, a reactive halogen compound, an isocyanate compound, a reactive ester compound, a compound having an aldehyde group and a deaminating agent are more preferable of the above compounds. An embodiment is more preferable in which any cross-linking between gelatin molecules can not be formed by the chemical modification. "Substantially can not be formed" means that the ratio of such a group is at most 10% and more preferable 0-3% of the chemically modified groups.

Further, the chemical modification in which modification of one —$NH_2$ group accompanies introduction of one to three —COOH groups is preferable, and that in which modification of one —$NH_2$ group accompanies introduction of one —COOH group is more preferable. As the reagent for the chemical modification, succinic anhydride, phthalic anhydride and maleic anhydride are usable for introducing one —COOH group per modification of one —$NH_2$ group, while trimellitic anhydride is usable for introducing two —COOH groups, and pyromellitic anhydride is usable for introducing three —COOH groups.

Specifically, phthalated gelatin obtained by chemically modifying a —$NH_2$ group by phthalic anhydride is preferable since it enhances the effects of the targeted invention and can be industrially and stably produced.

Regarding details of the reagent for chemical modification, chemical modification method for gelatin and others, the following documents can be referred to: JP-A Nos. 4-226449, 50-3329, U.S. Pat. Nos. 2,525,753, 2,614,928, 2,614,929, 2,763,639, 2,594,293 and 3,123,945, Y. Abiko "Glue and Gelatin" Sec. II, Glue Gelatin Manufacturers Association of Japan, 1987, and Ward et al. "The Science and Technology of Gelatin" Sec. 7, Academic Press, 1977.

The chemically modified gelatin relating to this invention preferably has an amino group modification ratio of 30-100%, more preferably 30-90%, and particularly preferably 45-80%.

When the modification ratio is less than 30%, the coagulation and precipitation capability in the desalting process is lowered and a large amount of coagulating agent is required which adversely affects the photographic properties.

Methionine content of the chemically modified gelatin of the invention is preferably at least 30 μmoles/g and more preferably at least 35 μmoles/g, though the content is not specifically limited.

The average molecular weight of the chemically modified gelatin is preferably 10,000-200,000 but more preferably 20,000-90,000.

The chemical modification ratio of the —$NH_2$ groups of gelatin can be determined as follows. The number of —$NH_2$ groups in the gelatin without modification e1, and that in chemically modified gelatin e2 were measured and the modification ratio in percent was calculated by 100×(e1−e2)/e1. e1 and e2 can be measured by infrared absorption caused by the —$NH_2$ group, NMR signal strength caused by the protons of the —$NH_2$ group or a method utilizing a coloring reaction or fluorescence reaction. Regarding details of the measurement, "Handbook of Analytical Chemistry, Organic-2", Maruzen, 1991, can be referred to. Further, measurement based on variation in the titration curve of gelatin or a formol titration method can be applied. As to details of such methods, "The Science and Technology of Gelatin", Sec. 15, Academic Press, can be referred to.

Timing of addition of the amino group modified gelatin is not specifically limited in this invention. The gelatin chemically modified by the method for introducing one —COOH group per modification of one —$NH_2$ group is preferably conducted before the desalting process (or at least before starting of the desalting process) though the modified gelatin is usually added in the course of formation of silver halide particles, just before the desalting process or in the redispersing process after desalting.

Organic Polymer

The method of separation by precipitation of this invention is characterized in that the organic polymer exhibiting a log P value of 0.8-2.0 is added to the photosensitive silver halide particle dispersion using a natural polymer as the protective colloid to result in separation.

The polymer relating to this invention has a function to precipitate and separate the silver halide particles, when it is added and mixed with the photosensitive silver halide particle dispersion containing a natural polymer as the protective colloid, and is capable of functioning as the dispersing agent of the photosensitive silver halide particles in the organic solvent type dispersion. It is more preferable that the organic polymer has a function to easily cause dispersion of the silver halide particles in the organic solvent system as a thermo-sensitive or a hydrophobic colloid. Namely, it is preferable that the polymer relating to this invention is water-soluble at no more than a specific temperature, so called the lower critical solution temperature (LCST) and can be made to be hydrophobic at a temperature more than the specific temperature.

The logarithm value of the n-octanol/water partition coefficient (being a log P value) is an indicator expressing the hydrophobicity or hydrophilicity of a substance. The value is determined by dissolving an objective substance in a solvent not miscible with water, usually n-octanol, and mixing with water and determining the logarithm of the ratio of concentrations of the substance in the organic solvent to that in the water (concentration in organic solvent/concentration in water) to create an equilibrium state.

The logarithm value of the n-octanol/water partition coefficient (being a log P value) can be measured by the flask shaking method described in OECD GUIDELINE FOR THE TESTING OF CHEMICALS, Adopted by the Council on 27 Jul. 1995, Partition Coefficient (n-octanol/water): Shake Flask Method, [and also JIS Z7260-107 (2000)]. The n-octanol/water partition coefficient (being the log P value) can also be estimated by a chemically computational method or an empirical method instead of the experimental measurement. As the computational method, Crippen's Fragmentation Method described in J. Chem. Inf. Comput. Sci. 27, 21 (1987), Viswanadhan's Fragmentation Method described in J. Chem. Inf. Comput. Sci. 29, 163 (1989), and Broto's Fragmentation Method described in Eur. J. Med. Chem.-Chim. Theor. 19, 71 (1984) are preferably applied. Of the above methods, Crippen's Fragmentation Method is preferable. When the log P value of a substance differs from the measuring method or the calculating method, the conclusion of that the substance is within the range of the invention or not is preferably judged by Crippen's Fragmentation Method.

There is no limitation as to the organic polymer, hereinafter also referred to as synthesized polymer, usable in this invention as long as the polymer has a log P value of 0.8-2.0. Examples of such a polymer include polyvinyl alcohols, hydroxyethyl celluloses, cellulose acetates, cellulose-acetate butylates, polyvinyl pyrrolidones, casein, starch, polyacrylic acids and polyacrylic acide esters, polymethacrylic acid and polymethacrylic acids, polyvinyl chlorides, polymethacrylic acids, styrene-maleic anhydride copolymers, styrene-acrylonitrile copolymers, styrene-butadiene copolymers, polyvinyl acetals (such as polyvinyl formal and polyvinyl butyral), polyesters, polyurethanes, phenoxy resins, polyvinylidene chlorides, polyepoxides, polycarbonates, polyvinyl acetates, polyolefins, cellulose esters and polyamides.

These synthesized polymers may be a copolymer of several kinds of them, but a synthesized copolymer, formed by copolymerization of monomers such as acrylic acid, methacrylic acid and an ester of them, is preferred.

The synthesized polymer include a polymer capable of becoming selectively soluble or insoluble in water or the organic solvent by controlling the pH or temperature, though it may be a polymer soluble in both water and the organic solvent at the same condition.

For example, a kind of polymer having an acidic group such as a carboxyl group can be made to be hydrophilic in the dissociated state and can be made to be lipophilic in a non-dissociated state by lowering the pH to allow dissolving in the solvent. On the contrary, a polymer having amino groups is made lipophilic by raising the pH, while its water solubility is raised by lowering the pH as a result of ionization.

The phenomenon of a cloud point of nonionic surfactants is well know, and a polymer which becomes lipophilic and oil soluble upon rise of temperature, and becomes hydrophilic and water soluble by lowering the temperature is also included in the invention. The polymer may be one capable of forming a micelle and being uniformly emulsified may be used even if it is not completely dissolved.

In this invention, various kinds of monomers are combined; therefore, the kind and the amount of monomer cannot be specifically described. But it is easily understood that the desired polymer can be obtained by a combination of a hydrophilic monomer and a hydrophobic monomer at an appropriate ratio.

As the polymer soluble in both water and an organic solvent, preferable is one which has a solubility in water of at least 1% by weight at 25° C. and that in the solvent such as methyl ethyl ketone of at least 5% by weight at 25° C. under controlled or uncontrolled conditions such as a pH value during dissolution.

As a polymer soluble in both water and an organic solvent relating to this invention, a block polymer, graft polymer or comb type polymer are more suitable than a straight-chain polymer from the viewpoint of solubility. The comb type polymer is particularly preferable. The isoelectric point of the polymer is preferably at most 6.

Various methods can be applied for producing the comb type polymer. It is preferable that a monomer capable of introducing a side chain having a molecular weight of at least 200 to the comb portion (being a side chain) is preferable. Particularly, an ethylenic unsaturated monomer containing a polyoxyalkylene group such as ethylene oxide or propylene oxide is preferable.

As the polyoxyalkylene group-containing ethylenic unsaturated monomer, one having a polyoxyalkylene group represented by the following formula is preferred.

$$-(EO)_k-(PO)_m-(TO)_n—R$$

In the above formula, E is an ethylene group, P is a propylene group, T is a butylene group and R is a substituent. The butylene group includes a tetramethylene group and an isobutylene group. k, m and n are each an integer of 1-300, 0-60 and 0-40, preferably 1-200, 0-30 and 0-20, respectively, provided that the sum of k, m and n is equal to or larger than 2.

The polyoxyalkylene group-containing ethylenic unsaturated monomer may be used singly or in combinations of plural kinds thereof.

The substituent represented by R includes an alkyl group such as a methyl group, an ethyl group, a propyl group, a butyl group, a hexyl group, an octyl group and a dodecyl group; an aryl group such as a phenyl group and a naphthyl group; and a heterocyclic group such as a thienyl group and a pyridyl group. These groups further may have a substituent including a halogen atom; an alkoxy group such as a methoxy group, an ethoxy group and a butoxy group; an alkylthio group such as a methylthio group and a butylthio group; an acyl group such as an acetyl group and a benzoyl group; an alkanamido group such as an acetamido group and a propionamido group; and an arylamido group such as a benzoylamido group; and these substituents may further be substituted with the above substituents.

The polyoxyalkylene group represented by the foregoing formula can be introduced into the polymer by the use of the ethylenic unsaturated monomer incorporating the polyoxyalkylene group. Examples of an ethylenic unsaturated monomer are a polyoxyalkylene acrylate and polyoxyalkylene methacrylate, and the polyoxyalkylene acrylate and polyoxyalkylene methacrylate can be produced by reacting a hydroxypoly(oxyalkylene) material, available on the market such as, for example, Pluronic and Adeca Polyether both manufactured by Asahi Denka Kogyo Co., Ltd., Carbowax manufactured by Glyco Products Co., Ltd., Tiriton manufactured by Rohm and Haas Co., Ltd., and P.E.G. manufactured by Dai-ichi Kogyo Seiyaku Co., Ltd., with acrylic acid, methacrylic acid, acryl chloride, methacryl chloride or acrylic anhydride by a known method. Other than the above, poly(oxyalkylene) diacrylate prepared by a known method may also be used.

As a monomer available on the market, hydroxyl-terminated polyalkylene glycol (meth)acrylates each manufactured by NOF Corp. as Blemmer PE-90, Blemmer PE-200, Blemmer PE-350, Blemmer AE-90, Blemmer AE-200, Blemmer AE-400, Blemmer PP-1000, Blemmer PP-500, Blemmer PP-800, Blemmer AP-150, Blemmer AP-400, Blemmer AP-550, Blemmer AP-800, Blemmer 50PEP-300, Blemmer 70PEP-350B, Blemmer AEP series, Blemmer 55PET-400, Blemmer 30PET-800, Blemmer 55PET-800, the Blemmer AET series, Blemmer 30PPT-800, Blemmer 50PPT-800, Blemmer 70PPT-800, the Blemmer APT series, Blemmer 10PPB-500B and Blemmer 10APB-500B are cited. Further, alkyl-terminated polyalkylene glycol mono (met)acrylate such as Blemmer PME-100, Blemmer PEM-200, Blemmer PEM-400, Blemmer PEM-1000, Blemmer PEM-4000, Blemmer AME-400, Blemmer 50POEP-800B, Blemmer PLE-200, Blemmer ALE-200, Blemmer ALE-800, Blemmer PSE-400, Blemmer PSE-1300, the Blemmer ASEP series, the Blemmer PKEP series, the Blemmer AKEP series, Blemmer ANE-300, Blemmer ANE-1300, Blemmer PNEP series, the Blemmer PNPE series, Blemmer 43ANEP-500 and Blemmer 70ANEP-550, each manufactured by NOE° Corp.; and Light-Ester MC, Light-Ester 130MA, Light-Ester 041MA, Light-Acrylate BO-A, Light-Acrylate EC-A, Light-Acrylate MTG-A, Light-Acrylate 130A, Light-Acrylate DPM-A, Light-Acrylate P-200A, Light-Acrylate NP-4EA and Light-Acrylate NP-8EA, each manufactured by Kyoei-sha Kagaku Co., Ltd., may be employed.

As the synthesized polymer relating to this invention, a graft polymer using a macromer is also usable appropriate. Examples of such polymers are described in "Shin Koubumshi Jikken-gaku 2, Gousei•Hannou (Polymer Experiments 2, Synthesis and Reaction)", edited by The Society of Polymer Science, Japan, and published by Kyoritu Shuppan Co., Ltd., 1995 and Y. Yamashita "Chemistry and Industry of Macromonomers", published by IPC, 1989. Functional molecular weight of the macromer is within the range of 10,000-100,000, preferably 10,000-50,000, and particularly preferably 10,000-20,000. No desired effect can be obtained when the molecular weight is less than 10,000, and copolymerization capability with the copolymer constituting the principal chain is degraded when the molecular weight is more than 100,000. Specifically, AA-6, AS-6S and AN-6S, each manufactured by Toagosei Co., Ltd., are employed.

This invention is not limited to the above examples. The ethylenic unsaturated monomer containing a polyoxyalkylene group may be employed singly or in combinations of plural kinds thereof.

Examples of other monomer to be reacted with the above-described monomer include acrylic acid esters, methacrylic acid esters, acrylamides, methacrylamides, allyl esters, alkyloxy ethanols, vinyl ethers, vinyl esters, dialkyl itaconates, di-slkyl esters or mono-alkyl esters of fumaric acid, crotonic acid, itaconic acid, acrylonitrile, methacrylonitrile, maleilonitrile and styrene. As specific examples, the following compounds may be cited.

Acrylic acid esters: methyl acrylate, ethyl acrylate, propyl acrylate, chloroethyl acrylate, 2-hydroxyethyl acrylate, trimethylpropane monoacrylate, benzyl acrylate, methoxybenzyl acrylate, furfuryl acrylate and tetrahydrofurfuryl acrylate Methacrylic acid esters: methyl methacrylate, ethyl methacrylate, propyl methacrylate, chloroethyl methacrylate, 2-hydroxyethyl methacrylate, trimethylpropane monomethacrylate, benzyl methacrylate, methoxybenzyl methacrylate, furfuryl methacrylate and tetrahydrofurfuryl methacrylate Acrylamides: acrylamide, N-alkylacrylamide (including an alkyl group having 1-3 carbon atoms such as a methyl group, an ethyl group and a propyl group), N,N-dialkylamide, N-dihydroxyethyl-N-methylacrylamide and N-2-acetoamidoethyl-N-acetylacrylamide, an alkyloxyacrylamide (such as methoxymethylacrylamide and butoxymethylcarylamide)

Methacrylamides: methacrylamide, an N-alkylmethacrylamide, N-hydroxyethyl-N-methyl-methacrylamide, N-2-acetoamidoethyl-Nacetylmethacrylamide, methoxymethylmethacylamide and butoxymethylmethacrylamide Allyl compounds: allyl esters (such as allyl acetate, allyl capronate, allyl caprylate, allyl laurate, allyl parmitate, allyl stearate, allyl benzoate, allyl acetoacetate and allyl lactate), and allyloxyethanol Vinyl ethers: alkyl vinyl ethers (such as hexyl vinyl ether, octyl vinyl ether, decyl vinyl ether, ethylhexyl vinyl ether, methoxethyl vinyl ether, ethoxethyl vinyl ether, chloroethyl vinyl ether, 1-methyl-2,2-dimethylpropyl vinyl ether, 2-ethylbutyl vinyl ether, hydroxyethyl vinyl ether, diethylene glycol vinyl ether, dimethylaminoethyl vinyl ether, diethylaminoethyl vinyl ether, benzyl vinyl ether and terahydrofurfuryl vinyl ether)

Vinyl esters: vinyl butylate, vinyl isobutylate, vinyl trimethylacetate, vinyl diethylacetate, vinyl valerate, vinyl caproate, vinyl chloroacetate, vinyl dichloroacetate, vinyl methoxyacetate, vinyl butoxyacetate, vinyl lactate, vinyl β-phenylbutylate and vinyl cyclohexylcarboxylate Dialkyl itaconates: dimethy itaconate, diethyl itaconate and dibutyl itaconate;

Di-alkyl esters or mono-alkyl esters of fumaric acid: dibutyl fumarate

Others: Crotonic acid, itaconic acid, acrylonitrile, methacrylonitrile, maleironitrile and styrene To introduce an amido group, a straight- or branched-chain alkyl group having 4-22 carbon atoms, an aromatic group or a 5 or more member heterocyclic group, a monomer having such the functional group may be selected from the above-mentioned monomers and other appropriate ones. For instance, 1-vinylimodazole or a derivative thereof can be used to introduce at least a 5 member heterocyclic group. Various functional groups can be introduced by reacting a polymer in which an isocyanate group or an epoxy group is previously introduced with an alcohol, or an amine each containing a straight- or branched-chain alkyl group, an aromatic group or at least a five member heterocyclic group. To introduce the isocyanate group or epoxy group, Karenz MOI, manufactured by Showa Denko Co., Ltd., and Blemmer G, manufactured by NOF Corp., can be employed. A urethane bond is also preferably introduced.

An azo type high molecular weight polymerization initiator and an organic peroxide compound may be used as a polymerization initiator. Examples of the azo type high molecular weight polymerization initiator include ABN-R (2,2'-azobis(2,4-dimethylisobutylnitrile), ABN-V (2,2'-azobis(2,4-dimethylvaleronitrile), and ABN-E (2,2'-azobis(2,4-methylbutylonitrile), each manufactured by Japan Hydrazine Co., Inc. Examples of the organic peroxide compound include benzoyl peroxide, dimethyl ethyl ketone peroxide, lauryl peroxide, and Pertetra A, Perhexa HC, Perhexa THM, Perhexa C, Perhexa V, Perhexa 22, Perhexa MC, Perbutyl H, Perkmil H, Perkmil P, Permenta H, Perocta H, Perbutyl C, Perbutyl D, Perhexyl D, Peroyl IB, Peroyl 355, Peroyl L, Peroyl S, Peroyl SA, Nyper BW, Nyper BMT-K40, Nyper BMT-T40, Nyper BMT-M, Peroyl IPP, Peroyl NPP, Peroyl TCP, Peroyl EPP, Peroyl MBP, Peroyl OPP, Peroyl SBP, Perkmil ND, Perocta ND, Percyclo ND, Perhexyl ND, Perbutyl ND, Perhexyl PV, Perhexa 250, Perocta O, Perhexyl O, Perbutyl O, Perbutyl IB, Perbutyl L, Perbutyl 355, Perhexyl I, Perbutyl I, Perbutyl E, Perhexa 25Z, Perhexa 25MT, Perbutyl A, Perhexyl Z, Perhexyl ZT and Perbutyl Z, each manufactured by NOF Corp.

A quinone type prohibiting agent may be used as polymerization prohibiting agent. Examples of such include hydroquinone, p-methoxyphenol, and phenothiazine, methoquinone, Nonflex Alba, MH (methylhydroquinone), TBH (tert-butylhydroquinone), PBQ (p-benzoquinone), Toluquinone, TBQ (tert-butyl-p-benzoquinone) and 2,5-diphenyl-p-benzoquinone, each manufactured by Seiko Chemical Co., Ltd.

The isoelectric point of the polymer relating to this invention is preferably at most 6. As to be explained later, the use of a polymer having a higher isoelectric point accelerates decomposition of the silver halide particle during desalting of the silver halide particles so as to result in adverse influence of the photographic properties. In addition, the use of polymers having a high isoelectric point is undesirable from the viewpoint of fogging because the silver halide particles using such a polymer are dispersed with difficultly in a solvent unless the pH is quite high. The isoelectric point of the polymer can be measured by an isoelectric focusing method or measurement of pH of a 1% aqueous solution of the polymer after passing it over a mixed bed column of cation and anion exchange resins.

Various acidic groups may be introduced to lower the isoelectric point of the polymer. A polymer having a carboxyl group can be obtained by using a monomer of acrylic acid or a methacrylic acid, and other than that, the polymer also can be obtained by partially decomposing a polymer containing methyl methacrylate. To introduce a sulfonic acid group, styrenesulfonic acid or 2-acrylamido-2-methylpropanesulfonic acid may be used as a monomer, and other than that, it can be introduced by various sulfating methods after the preparation of the polymer. The use of carboxylic acid is particularly preferable because the solubility of the polymer in the solvent is relatively high in a state of before neutralization and can be changed to become water-soluble by neutralization or half-neutralization. Neutralization can be carried out by a sodium or potassium salt, as well as an organic salt such as ammonia, monoethanolamine, diethanolamine and triethanolamine. Imidazole, triazole and amidoamine compounds may also be employed.

Polymerization is preferably performed in the presence of a solvent from the viewpoint of ease of production work though it may be either in the presence or absence of the solvent. Examples of preferable solvents include alcohols such as ethanol, iso-propanol, n-butanol, iso-butanol and tert-butanol; ketones such as acetone, methyl ethyl ketone and methyl amyl ketone; esters such as methyl acetate, ethyl acetate, butyl acetate, methyl lactate, ethyl lactate and butyl lactate; monocarboxylic acid esters such as methyl 2-methoxypropionate, ethyl 2-methoxypropionate, propyl 2-methoxypropionate and butyl 2-methoxypropionate; polar solvents such as dimethylformamide, dimethylsulfoxide and N-methylpyrrolydone; ethers such as methyl cellosolve, cellosolve, butyl cellosolve, butylcarbitol and ethyl cellosolve acetate; propylene glycols and ethers thereof such as propylene glycol, propylene glycol monomethyl ether, propylene glycol monomethylether acetate, propylene glycol monoethylether acetate and propylene glycol monobutylether acetate; halogenized solvents such as 1,1,1-trichloroethane and chloroform; ethers such as tetrahydrofuran and dioxane; aromatic compounds such as benzene, toluene and xylene; and fluorinated inert liquid such as perfluoroocatane and perfluorotri-n-butylamine.

A dropping polymerization method in which the polymerization is carried out while dripping the monomer and the initiator into the reaction vessel is effective to obtain a polymer uniform in composition according to the polymerization property of the monomer. Any residual non-reacted monomer can be removed by column filtration, re-precipitating purification or extraction by solvent. A low-boiling non-reacted monomer can be removed by stripping.

As particularly preferable examples of the polymer, copolymers constituted by the following monomers may be cited: NIPAM (N-iso-propylacrylamide)/PSE (stearoxy-polyethylene glycol monomethacrylate)-400, DAAM (diacetoneacrylamide)/PSE-400, DAAM/NIPAM/PSE-400, DAAM/NIPAM/PME (methoxy-polyethylene glycol monomethacrylate)/PSE, DAAM/AAm (acrylamide)/PME/PSE-400, DAAM/ACMO (acryloyl morpholine)/PME/PSE-400, and DAAM/HEAA (n-hydroxyethyl-acrylamide)/PME/PSE-400.

The amido group contained in DAAM or NIPAM and the carboxyl group contained in the natural polymer can be easily made as a composite by forming a hydrogen bond between them. The alkyl chain contained in PSE increases the affinity with the organic solvent so that precipitation in the aqueous solution is easily achieved while dispersing in the solvent is accelerated.

Photosensitive Silver Halide Particle Dispersion

The photosensitive silver halide particle dispersion of this invention is preferably in a state in which the particles are dispersed in the organic solvent to achieve a maximum moisture content of at most 10%.

The organic solvent having a moisture content of not more than 10% relating to this invention is not specifically limited as long as the moisture content is a maximum of 10%, but preferably 0.1-10%, of which an alcohol type, an ester type and a ketone type solvents are preferable. Particularly, a ketone type organic solvent such as acetone, methyl ethyl ketone or diethyl ketone is preferred. The moisture content of the organic solvent in this invention can be measured by the Karl-Fischer method. Specifically, the moisture content can be measured by the Karl-Fischer moisture evaporation apparatus VA-06, manufactured by Mitsubishi Kagaku Co., Ltd.

In the preparation of the photosensitive silver halide particle dispersion relating to this invention, the use of a synthesized polymer together with a natural polymer as the protective colloid for dispersion is preferable to enhance the targeted effects of this invention.

During preparation of the photosensitive silver halide particle dispersion, the silver halide particles are preferably dispersed in the presence of the protective colloid for dispersing, and the use of a synthesized polymer or a synthesized polymer together with a natural polymer for the protective colloid for dispersion is preferable.

Further, the synthesized polymer is preferably a compound having an amido group as a functional group while the natural polymer is preferably a compound having a carboxyl group as a functional group.

In the course of production of the silver salt photothermographic dry imaging material, a surfactant, particularly a nonionic surfactant, is preferably added to the silver halide particle dispersion to prevent aggregation and achieve uniform dispersing of the silver halide particles.

According to Griffin W. C., J. Soc. Cosm. Chem., 1, 311 (1949), the nonionic surfactant is generally selected from nonionic hydrophilic compounds having a hydrophilicity/hydrophobicity equilibrium of −18 to 18, preferably −15 to 0, defined by HLB value corresponding to the ratio of hydrophilicity to hydrophobicity in the molecule.

Nonionic surfactants represented by following Formula NAS1 or NAS2 are preferably used for the photosensitive silver halide emulsion of this invention.

$$HO—(EO)_a—(AO)_b—(EO)_c—H \qquad \text{Formula NAS1}$$

$$HO—(AO)_d—(EO)_e—(AO)_f—H \qquad \text{Formula NAS2}$$

In the formulas, EO is an oxyethylene group, AO is an oxyalkylene group of at least 3 carbon atoms, and a, b, c, d, e and f are each an integer of at least 1.

The above compounds are known as Pluronic type nonionic surfactants, and the oxyalkylene group having at least 3 carbon atoms represented by AO in Formulas NAS1 and NAS2 is, for example, an oxypropylene group, an oxybutylene group or an oxy-long chain-alkylene group, of which the oxypropylene group is most preferable.

a, b, c, d, e and f are each an integer of at least 1 while a and c are preferably 1-200 and more preferably 10-100, b is preferable 1-300 and more preferably 10-200, d and f are each preferably 1-100 and more preferably 5-50, and e is preferably 1-100 and more preferably 2-50.

An average molecular weight of the Pluronic type nonionic surfactant represented by Formula ANS1 or ANS2 is preferably about 500-30,000 and more preferably 1,000-20,000. In at least one kind of the Pluronic type nonionic surfactants represented by ANS1 or ANS2, the ratio of the oxyethylene group is preferably at most 50% by weight.

Examples of such a type of nonionic surfactant include Pluronic® P94 and Pluronic® F68.

In this invention, the nonionic surfactant is used at a concentration of 0.5-2% and preferably 0.9-1.5%.

The photosensitive silver halide particles to be used in the photosensitive silver halide particle dispersion of this invention are described below.

The photosensitive silver halide particle, which is also simply called as silver halide particle or silver halide in the field of photographic industry, and relating to this invention, is a silver halide crystal particle which is treated and produced so that the particle inherently absorbs light and specifically absorbs visible light or infrared light by a physicochemical method, during which physicochemical variation can occur in the interior or on the surface of the silver halide particle when the particle absorbs any light in the wavelength range of from ultraviolet to infrared.

As the photosensitive silver halide particle relating to this invention, silver halide particle disclosed in many publications relating to silver salt photothermographic dry-image material may be used. Specific example of a preferable silver halide particle is a silver halide, produced by the production method described in JP-A 2003-270755, or methods considering chemical natures such as halide composition and physical natures such as particle shape.)Please refer to Example of this invention.)

The halide composition is not limited, and may be any of silver chloride, silver chlorobromide, silver iodochloride, silver bromide, silver iodobromide and silver iodide, and silver bromide, silver iodobromide and silver iodide are preferably preferred.

A suitably small particle is preferable for the silver halide particle to be used in this invention to prevent the white turbidity after image formation and to obtain higher image quality. An average particle diameter is preferably 0.03-0.055 μm, while particles at a diameter of less than 0.02 μm are discarded for measurement.

The shape of the particles may be cubic, octahedral, tetradecahedral, planar, granule, spherical or potato-like. Of these, the cubic, octahedral, tetradecahedral and planar particle shapes are preferable.

It is preferable that the photosensitive silver halide particles are used in an amount of 0.001-0.7 moles, but preferably 0.03-0.5 moles, per mole of silver aliphatic carboxylate capable of functioning as the silver ion supply source.

The photosensitive silver halide particles relating to this invention are preferably a thermal conversion internal latent image type (being an internal latent image forming type after thermal development) silver halide particle described in JP-A Nos. 2003-270755 and 2005-106927. That is, such silver halide particles are changed from a surface latent image type to an internal latent image type after the thermal development so that the surface sensitivity is lowered. In other words, in such silver halide particles, a latent image capable of functioning as a catalyst for a developing reaction or a reducing reaction of silver ions by a silver ion reducing agent is formed on the surface of silver halide particle by exposure before thermal development and a larger number of latent images is formed in the interior than on the surface of the silver halide particle by exposure after thermal development. Consequently, formation of surface latent image is restrained in such silver halide particle, which is preferable from the viewpoint of sensitivity and storage stability of images.

The thermal conversion internal latent image type silver halide particle of this invention is preferably used in an amount of 0.01-0.7 moles, and more preferably 0.03-0.5 moles, per mole of the silver aliphatic carboxylate capable of functioning as the silver ion supply source, being the same as in the case when the usual surface latent image type silver halide particle is used.

Photo-Insensitive Organic Silver Salt Dispersion

The photo-insensitive organic silver salt dispersion is preferably prepared by dispersing the photo-insensitive organic silver salt in an organic solvent exhibiting a moisture content of less than 10%.

Though the organic solvent, exhibiting a moisture content of at most 10% of this invention, is not specifically limited as long as the moisture content does not exceed 10%, but is preferably 0.1-100, of which an alcohol type, an ester type or a ketone type solvents is preferable. Particularly, a ketone type organic solvent such as acetone, methyl ethyl ketone or diethyl ketone is preferred.

The moisture content of the organic solvent of this invention can be measured by the Karl-Fischer method. Specifically, the moisture content can be measured by the Karl-Fischer moisture evaporation apparatus VA-06, manufactured by Mitsubishi Kagaku Co., Ltd.

The photo-insensitive organic silver salt relating to this invention is preferably a photo-insensitive silver aliphatic carboxylate, though there is no specific limitation. The photo-insensitive silver aliphatic carboxylate is a silver salt which is relatively stable to light and functional as a silver ion supply source to form a silver image when the salt is heated to at least 80° C. in the presence of exposed photosensitive silver halide and a reducing agent.

The photo-insensitive silver aliphatic carboxylate of this invention may be any silver aliphatic carboxylate capable of supplying silver ions which can be reduced by a reducing agent. The silver aliphatic carboxylate is preferably silver salt of a long chain aliphatic carboxylic acid having 10-30, but preferably 15-28 carbon atoms. Preferable examples of the silver aliphatic carboxylate include silver lignocerate, silver behenate, silver arachidate, silver stearate, silver oleate, silver laurate, silver capronate, silver myristate, silver parmitate, silver erucate and mixtures thereof.

In this invention, the photo-insensitive organic silver salt (being the silver aliphatic carboxylate salt) contains silver behenate preferably in the amount of not less than 50 mol % and not more than 100 mol %, and further, more preferably not less than 80 mol % and not more than 100 mol %. Further, the silver aliphatic carboxylate salt containing silver erucate is employed preferably in the amount of not more than 2 mol %, more preferably not more than 1 mol %, and still more preferably not more than 0.1 mol %.

In this invention, the sphere-corresponding diameter of the photo-insensitive organic silver salt particle is preferably 0.05-0.50 μm, but more preferably 0.10-0.50 μm. Further, the size distribution of particles is preferably monodispersed one. The degree of monodispersion can be expressed via standard deviation of the average diameter. The standard deviation of the photo-insensitive organic silver salt particle is preferably not more than 0.3 and more preferably 0.01-0.2.

The particle diameter and the distribution thereof can be measured by common methods such as a laser diffraction method, a centrifugal precipitation light transmission method, an X-ray transmission method, an electric detection band method, a light shading method, an ultrasonic attenuation spectrum method and a method calculating from the image. Of these, the laser diffraction method and the method of calculating from the particle image are preferable for minute particles. However, the laser diffraction method is more preferable and the silver aliphatic carboxylate particles dispersed in a liquid can be measured by a commercial laser diffraction particle size distribution measuring apparatus.

A specific example of measurement of the particle diameter and its distribution of the photo-insensitive organic silver salt particles is described below.

Into a 100 ml beaker, 0.01 g of silver aliphatic carboxylate is charged and 0.1 g of Nonion N-210, manufactured by NOF Corp., and 40 ml of water are added. Then the mixture is dispersed by ultrasonic waves at room temperature. The average particle diameter and its standard deviation can be measured by the thus obtained dispersion using a laser diffraction particle size distribution measuring apparatus, namely SALD-2000 manufactured by Shimadzu Seisakusho Co., Ltd.

To prepare the photo-insensitive silver aliphatic carboxylate particles so as to make an average sphere-corresponding diameter of 0.05-0.50 μm targeted in this invention and a maximum standard deviation of 0.3, the particles are preferably prepared by the following mixing method.

The silver aliphatic carboxylate in this invention is preferably formed by reaction of a solution containing silver ions with a solution, or suspension of an alkali salt of an aliphatic carboxylic acid. The solution containing the silver ions is preferably a silver nitrate aqueous solution, and the solution or dispersion of the metal aliphatic carboxylate is preferably an aqueous solution or aqueous dispersion of the metal carboxylate. The mixing method is preferably a double-jet mixing method such as a method in which the liquids are added onto the surface of the reacting liquid, and a method in which the liquids are added to the interior of the reacting liquid, while the preferred method is one in which the liquids are added and mixed via a liquid conveying means, which is an in-line mixing means, and the mixing of the solution containing silver ion, or the solution or dispersion of the alkali aliphatic carboxylate is preferably completed before pumping the mixed liquid into a stored batch of the mixed liquid containing the reaction products. As the mixing means at the mixing point, a mechanical stirring means such as a Homomixer, a static mixer or a turbulent flow effect may be employed, however the use of the mechanical means is not preferred. A third liquid or suspension such as water and the circulating part of the mixed liquid stored in the batch after the mixing may be added into the liquid conveying means.

In this invention, the concentration of the silver nitrate solution is preferably 1-15% by weight, while that of the solution or suspension of the metal aliphatic carboxylate is preferably 1-5% by weight.

Regions of a concentration lower than the above range is not desirable because the production efficiency is lowered considerably while a higher concentration than the above range is also not practical because the particle size and its distribution are not easily controlled within the range of this invention. The mole ratio of silver nitrate to the alkali aliphatic carboxylate is preferably within the range of 0.9-1.1. Beyond this range, the particle size and its distribution are not easily controlled within the range of this invention and a lower yield of the silver aliphatic carboxylate, and forming of silver oxide causing fog, tend to occur.

From the viewpoint of the storage stability in this invention, the prepared silver aliphatic carboxylate is preferably washed with water and then dried. Washing with water is carried out to remove unreacted ions, but the washing may be performed with an organic solvent considering the drying process following the washing process. Washing with water is preferably carried out at a temperature of not more than 50° C., and more preferably not more than 30° C. When the washing process is carried out at a temperature higher than 50° C., the particle size and its distribution are not easily controlled within the range of this invention. Drying is preferably performed at a temperature lower than the phase conversion temperature of the silver aliphatic carboxylate. Further, the temperature is preferably not more than 50° C. and more preferably temperature as low as practical. When the drying is performed at a temperature higher than the phase conversion temperature, the particle size and its distribution are not easily controlled within the range of this invention.

In this invention, the preparation of the silver aliphatic carboxylate is preferably performed with presence of no photosensitive silver halide particles. When the preparation is carried out in the presence of the photosensitive silver halide particles, the particle size and its distribution are controlled with difficulty within the range of the invention by the lack of compatibility of fogging property.

Though the photo-insensitive silver aliphatic carboxylate can be used in an general amount, the amount is preferably from 0.8 to 1.5 g/m$^2$, and more preferably from 1.0 to 1.3 g/m$^2$, within the total amount of the silver halide.

Preparation of the alkali aliphatic carboxylate is necessary in advance of the preparation of the silver aliphatic carboxylate. Examples of an alkali metal salt usable in the preparation of the alkali aliphatic carboxylate are sodium hydroxide, potassium hydroxide and lithium hydroxide. Any one of them is preferably used solely but a combination use of sodium hydroxide and potassium hydroxide is also acceptable. The used mole ratio of the hydroxides is preferably from 10:90 to 75:25. The viscosity of the reacting liquid can be suitably controlled by the use of the hydroxides mixed in the above ratio when the alkali aliphatic carboxylate is formed by the reaction with the aliphatic carboxylic acid.

The photo-insensitive silver aliphatic carboxylate dispersion containing the silver aliphatic carboxylate particles relating to this invention is a mixture of the unreacted free aliphatic carboxylic acid and the silver aliphatic carboxylate, and it is preferable that the ratio of the former is lower than that of the latter from the viewpoint of image storage ability. The emulsion of this invention preferably contains the aliphatic carboxylic acid at a ratio of from 3 to 10 mole-%, but is particularly preferably from 4 to 8 mole-%, of the silver aliphatic carboxylate particles.

Specifically, the amount of silver aliphatic carboxylate and that of free aliphatic carboxylic acid and their ratio, and the ratio of the free aliphatic carboxylic acid to the entire aliphatic carboxylic acid may be calculated by the entire aliphatic carboxylic amount and the free aliphatic carboxylic acid measured by the following procedure.

[Determination of the Total Aliphatic Carboxylic Acid Amount (Being the Total of the Aliphatic Carboxylic Acid Derived from the Silver Aliphatic Carboxylate and the Free Acid)]

(1) About 10 mg of sample (the weight of peeled sample when the sample is peeled from the photosensitive material) was weighed precisely and put into a 200 ml eggplant type flask.

(2) Fifteen milliliter of methanol and 3 ml of a 4 moles/liter solution of hydrochloric acid are added and dispersed for 1 minute by ultrasonic waves.

(3) The dispersion is refluxed for 60 mins. after addition of boiling stones of Teflon®.

(4) After cooling, 5 ml of methanol is poured twice through the cooling pipe for washing off any adhering matter on the interior of the cooling pipe and into the eggplant type flask.

(5) Resultant reacting liquid is subjected for two times to extraction by ethyl acetate for two times (liquid separation extraction using 100 ml of ethyl acetate and 70 ml of water).

(6) The extracted substance is allowed to dry for 30 minutes at room temperature.

(7) Into a 10 ml measuring flask, 1 ml of benzanthrone solution is placed as an inner standard, which solution is prepared by dissolving about 100 mg in toluene and adjusting the total volume to 100 ml.

(8) The dried sample dissolved in toluene and placed into the measuring flask of (7) and the volume is adjusted to 100 ml in total by toluene.

(9) The resultant solution is subjected by gas chromatography under the following conditions.

Apparatus: HP-5890 and HP-Chemistation
Column: HP-1 30 m×0.32 mm×0.25 μm (Manufactured by HP)
Injecting opening: 250° C.
Detector: 280° C.
Oven: at a constant 250° C.
Carrier gas: He
Head pressure: 80 kPa (Determination of Free Aliphatic Carboxylic Acid)

(1) About 10 mg of sample was precisely weighed and placed into a 200 ml eggplant type flask and 10 ml of methanol was added and then dispersed by ultrasonic waves for 1 minute at 25° C., free organic acid was extracted.

(2) The dispersion was filtered and the filtrate was placed into a 200 ml eggplant type flask and dried, after which free organic carboxylic acid was separated.

(3) 15 ml of methanol and 3 ml of a 4 moles/liter solution of hydrochloric acid were added to the flask and dispersed for 1 minute by ultrasonic waves.

(4) The dispersion was refluxed for 60 minutes after addition of boiling stones of Teflon®.

(5) To the resultant reacting liquid, 60 ml of water and 60 ml of ethyl acetate and a methyl esterification compound of the organic carboxylic acid was extracted in the ethyl acetate phase. The ethyl ester extraction was repeated twice.

(6) The ethyl acetate phase was dried and further the dried residue was dried under vacuum for 30 minutes.

(7) Into a 10 ml measuring flask, 1 ml of benzanthrone solution was placed as an inner standard, the solution is prepared by dissolving about 100 mg in toluene and adjusting the total volume to 100 ml.

(8) The dried substance of paragraph (6) was placed into the measuring flask of paragraph (7) and the volume of liquid was adjusted with toluene.

(9) The resultant solution was subjected to gas chromatography under the following conditions.

Apparatus: HP-5890 and HP-Chemistation
Column: HP-1 30m×0.32 mm×0.25 μm (Manufactured by HP)
Injecting opening: 250° C.
Detector: 280° C.
Oven: at a constant 250° C.
Carrier gas: He
Head pressure: 80 kPa There is no limitation as to the shape of the silver aliphatic carboxylate particles and any of needle-like, rod-like, planer and scale-like ones are usable. In this invention, scale-shaped and short needle-shaped, as well as cubic-shaped ones, at a maximum ratio of major axis and minor axis of 5 are preferable.

In this invention, the scale-shaped silver aliphatic carboxylate particle is defined as follows. The silver aliphatic carboxylate particle is observed with an electron microscope, and the shape of the silver aliphatic carboxylate particle is approximated to a cuboid and the sides of it are referred to as a, b and c in the order of shortage of their lengths (c may be the same as b) and x is calculated as follows based on the shorter values of a and b.

$$X=b/a$$

The X value of about 200 particles are calculated and the their average value is referred to as X(average). The particles satisfying the relation of X(average)≧1.5 are defined as the scale-shaped particles. It is preferable that 30≧X(average)≧1.5, but more preferably 20≧X(average)≧2.0.

In the scale-shaped particle, "a" can be considered as the thickness of a planar particle having the principal plane constituted of sides "a" and "b". The average of "a" is preferably from 0.01 μm to 0.23 μm and more preferably from 0.1 μm to 0.20 μm. The average of c/b is preferably from 1 to 6, more preferably from 1.05 to 4, further more preferably from 1.1 to 3, and particularly preferably from 1.1 to 2.

The silver aliphatic carboxylate may be a crystal particle having a core/shell structure described in EP No. 1,168,069 and JP-A 2002-23303. In the core/shell structure, all or a portion of the core or shell may be constituted of a silver salt of an organic acid such as phthalic acid and benzimidazole, other than the silver aliphatic carboxylate.

In this invention, the planar silver aliphatic carboxylate particle may be preliminarily dispersed together with the binder and the surfactant based on functionality and then preferably crushed and dispersed by a media disperser or a high pressured homogenizer. For the preliminary dispersion, a usual dispersing machine such as an anchor type or a propeller type, a high speed rotating centrifugal radially releasing type stirring machine such as a dissolver, and a high speed rotating shearing type stirring machine such as a Homomixer, are usable.

As the medium dispersing machine, for example, a rotary mill such as a ball mill, a planet ball mill and a vibration ball mill, a medium stirring mill such as a bead mill and attriter, as well as a basket mill may be used. As the high pressure homogenizer, various types may be applied such as a type in which the liquid is struck against a wall or a plug, a type in which the liquid is separated into plural parts and collided against each other and a type in which the liquid is forced through a narrow orifice.

As the ceramic to be used for the ceramic beads on the occasion of dispersion by medium dispersing machine, yttrium-stabilized zirconia and zirconia-strengthen alumina, (hereinafter such ceramics containing zirconia is referred to as zirconia), are particularly preferable in the reason of that the impurity formation caused by friction with the beads or the stirring machine is very low.

In the apparatus to be used during dispersion the planar particle of silver aliphatic carboxylate relating to this invention, for example, a ceramic such as zirconia, alumina, silicone nitride or boron nitride, and diamond are preferable as the material of parts which contact the silver aliphatic carboxylate, of which zirconia is particularly preferred. On the occasion the dispersion, the binder concentration is preferably 0.1 to 10% by weight of the silver aliphatic carboxylate, and a temperature of not more than 45° C. is preferable through out the processes of preliminary dispersion through principal dispersion. Preferable operating conditions of the principal dispersing are a pressure of from 29 to 100 MPa, and two time operation when the medium dispersing machine is used as the dispersing means. When the medium dispersing machine is used as the dispersing means, the circumferential rate is preferably from 6 to 13 m/sec.

In this invention, the photo-insensitive silver aliphatic carboxylate particles are preferably formed in the presence of a compound functioning as a crystal growth inhibiting agent or as a dispersing agent. The compound functioning as the crystal growth inhibiting agent or as the dispersing agent is preferably an organic compound having a hydroxyl group or a carboxylic group.

In this invention, the compound functioning as the crystal growth inhibiting agent or as the dispersing agent is a compound displaying a miniaturizing or monodisperising effect on the particles when the silver aliphatic carboxylate is formed in the presence the compound compared to the particles formed in the absence of the compound. Specific examples of the compound include mono-valent alcohols having not more than 10 carbon atoms, and preferably a secondary alcohol, a tertiary alcohol, a glycol such as ethylene glycol and propylene glycol, a polyether such as a poly(ethylene glycol), and glycerol. The preferably added amount of the compound is from 10 to 200% by weight of the silver aliphatic carboxylate.

On the other hand, a branched-chain aliphatic carboxylic acid such as iso-heptanic acid, iso-decanic acid, iso-tridecanic acid, iso-myristic acid, iso-palmitic acid, iso-stearic acid, iso-arachidic acid, iso-behenic acid and iso-hexaconic acid each containing an isomer thereof are also functional. In such a case, the side chain thereof is preferably an alkyl group or an alkenyl group each having 4 or fewer carbon atoms. An aliphatic unsaturated carboxylic acid such as palmitoleic acid, oleic acid, linoleic acid, linolenic acid, moroctic acid, eicosenoic acid, arachidonic acid, eicosapentanoic acid, erucic acid, docosapentanoic acid, docosahexanoic acid and seracoic acid are also usable. The preferred added amount is from 0.5 to 10 mol % of the silver aliphatic carboxylate.

A glucoside such as glucoside, garcatoside and furctoside, a trehalose type disaccharide such as trehalose and suclose, a polysaccharide such as glycogen, dextrin, dextran and alginic acid, a cellosolve such as methyl cellosolve and ethyl cellosolve, a water-soluble organic solvent such as sorbitan, sorbite, ethyl acetate, methyl acetate and dimethylformamide, and a water-soluble polymer such as poly(vinyl alcohol), poly(acrylic acid), an acrylic acid copolymer, a maleic cid copolymer, carboxymethyl cellulose, hydroxypropyl cellulose, hydroxypropylmethyl cellulose, poly(vinyl pyrrolidone) and gelatin may be cited as most preferred compounds. The preferred added amount is 0.1 to 20% by weight of the silver aliphatic carboxylate.

Alcohols having 10 or fewer carbon atoms, preferably secondary alcohols such as iso-propyl alcohol or tertiary alcohols such as t-butyl alcohol, decreases the viscosity of the alkali aliphatic carboxylate solution by raising the solubility as the temperature is raised, so that stirring efficiency is raised and the particles of the silver salt are reduced and the distribution of the particle size becomes monodispersed. The branched-chain aliphatic carboxylic acid and the aliphatic unsaturated carboxylic acid display steric hindrance property higher than that of the principal composition of the silver salt of straight-chain aliphatic carboxylic acid preventing large crystals are not forming since disorder in the crystal lattice is promoted. As a result, the particles remain smaller.

Another structure of the silver salt photothermographic material of this invention is described below.

[Chemical Sensitization]

Chemical sensitization disclosed in various publications such as patent documents as to the silver salt photothermographic material can be applied to the photosensitive silver halide particle relating to this invention. A chemical sensitizing center (chemical sensitizing nucleus) capable of trapping an electron, or a positive hole, caused by photoexcitation of the photosensitive silver halide particle or the spectral sensitizer on the particle can be provided by applying a compound capable of releasing a charcogen such as sulfur, selenium or tellurium, or by a noble metal compound capable of releasing a noble metal ion based on the methods described in, for instance, JP-A Nos. 2003-270755, 2001-249428 and 2001-249426. Specifically, one chemically sensitized by an organic sensitizer containing the charcogen atom, is preferable.

The organic sensitizer containing the charcogen atom is preferably a compound exhibiting a group capable of adsorbing onto silver halide and a moiety having a labile charcogen atom.

As such an organic sensitizer, organic sensitizers of various structures disclosed in JP-A Nos. 60-150046, JP-A 11-218874, 11-218875, 11-218876 and 11-194447 are usable. Of these, the compounds exhibiting a structure in which the charcogen atom is bonded to a carbon atom or a phosphor atom are preferred, of which thiourea derivatives, each having a heterocyclic group and triphenylphosphine sulfide derivatives, are particularly preferred.

When the chemical sensitization is provided on the surface of the silver halide particle, the effect of the chemical sensitization is largely extinguished after thermal development. The large extinction of the effect of chemical sensitization means that the sensitivity of the imaging material is decreased after the thermal developing process to a maximum of 1.1 times of the sensitivity when no chemical sensitization is applied. To eliminate the effect of chemical sensitization after thermal developing, it is necessary to add a suitable amount of an oxidant capable of destroying the chemical sensitization center (chemical sensitization nucleus) by an oxidizing reaction such as a halogen radical releasable compound in the emulsion layer or/and the photo-insensitive layer. The added amount of such oxidant is preferably decided considering the oxidation capability of the oxidant and the targeted reducing degree.

The photosensitive silver halide particle relating to the invention is preferably spectrally sensitized by adsorbing a spectral sensitizing dye. For the spectral sensitization, a method using a cyanine dye, a merocyanine dye, a complex cyanine dye, a complex merocyanine dye, a holopolar cyanine dye, a styryl dye, a hemicyanine dye, an oxonol dye or a hemioxonol dye is applicable, which is disclosed in various US Patent documents regarding the silver salt photothermographic dry imaging materials.

A concrete example of the preferable spectral sensitizing methods applicable in the silver halide photothermographic dry imaging material is the method according to JP-A 2004-309758 in which at least one sensitizing dye represented by Formula 1 or Formula 2 is used.

The emulsion containing the photosensitive silver halide particles and the silver aliphatic carboxylate to be used in the silver salt photothermographic dry imaging material of this invention may be super sensitized by incorporating a substance displaying a super sensitizing effect, which exhibits no spectral sensitizing effect itself, together with the spectral sensitizing dye.

Useful sensitizing dyes, combination of dyes and the substances displaying the super sensitizing effect are described in Research Disclosure, (hereinafter referred to as RD), No. 17,634, Item V-J, p. 23, December 1978, Examined Japanese Patent Application Publication No. (hereinafter referred to as JP-B) 9-25500 and 43-4933, and JP-A 59-19032, 59-192242, and 5-341432. Hetero-aliphatic mercapto compounds and compounds of mercapto derivative are preferable as the super sensitizer.

Other than the above-mentioned, large ring compounds having a hetero atom disclosed in JP-A 2001-330918 are usable for the super sensitizer.

It is preferable that the photosensitive silver halide particle is spectrally sensitized by the spectral sensitizing dye adsorbed onto the particle surface, and the spectral sensitizing effect is largely extinguished after the thermal development treatment. To largely extinguish means that the sensitivity of the imaging material obtained by the sensitizing dye and the super sensitizer is lowered by no more than 1.1 times the sensitivity without the spectral sensitization.

To extinguish the spectral sensitizing effect, it is necessary to use a spectral sensitizing dye which easily releases the silver halide particle by heat or/and to add a suitable amount of a substance capable of destroying the spectral sensitizing dyes by an oxidizing reaction via such as a halogen radical releasing compound into the emulsion layer or/and photo-insensitive layer of the imaging material. The incorporated amount of the oxidant is preferably decided considering the oxidizing capability and the targeted reducing degree of the spectral sensitizing effect.

[Silver Ion Reducing Agent]

The silver ion reducing agent, related to this invention can reduce a silver ion in the photosensitive layer, which is also called a developing agent. Compounds represented by following Formula (RD1) are usable as the reducing agent.

In this invention, at least on compound represented by Formula RD1 is preferably used singly or in combination with another reducing agent differing in the structure.

Formula DR1

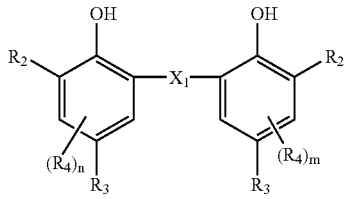

In above Formula RD1, $X_1$ is a charcogen atom or $CHR_1$, and $R_1$ is a hydrogen atom, a halogen atom, an alkyl group, an alkenyl group, an aryl group or a heterocyclic group. $R_2$ is an alkyl group, and the two groups representing $R_2$ may be the same or differ. $R_3$ is a hydrogen atom or a substituent capable of substituting on the benzene ring. $R_4$ is a substituent capable of substituting on the benzene ring, and m and n are each an integer of from 0 to 2.

Among the compounds represented by Formula RD1, high reactive reducing agents, hereinafter referred to the compounds of Formula 1a, in which at least one of $R_2$s is a secondary or tertiary alkyl group, are preferred to produce silver photothermographic dry imaging materials superior in high density and high fading resistance against light. In this invention, the use of a combination of the RD1a compound and a compound represented by following Formula RD2 is preferable to obtain targeted tone.

Formula RD2

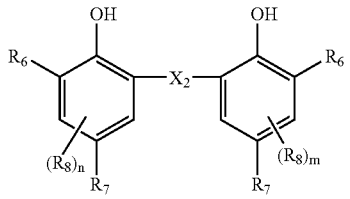

In above Formula RD2, $X_2$ is a charcogen atom or $CHR_5$, and $R_5$ is a hydrogen atom, a halogen atom, an alkyl group, an alkenyl group, an aryl group or a heterocyclic group. $R_6$ is an alkyl group, and the two groups represented by $R_6$ may be the same or differ, provided that they are not a secondary or tertiary alkyl group. $R_7$ is a hydrogen atom or a substituent capable of substituting on the benzene ring. $R_8$ is a substituent capable of substituting on the benzene ring, and m and n are each an integer of from 0 to 2.

The weight ratio of compound RD1a to compound RD2 is preferably from 5:95 to 45:55, but more preferably from 10:90 to 40:60.

[Tone of Image]

The tone of images produced by thermally development of the silver salt photothermographic dry imaging material is described below.

It has been known that "a cold tone image" is suitable for medical diagnosis image such as common radiophotography to easily make accurate diagnosis result by a typical image reader. "Cold tone image" means an image of pure black or bluish black color areas, while "warm tone image" means an image of brownish black color areas. The tone is described by the expression method recommended by International Commission on Illumination to enable exact and quantitative discussions.

The terms as to the tone of "more cold tone" and "more warm tone" can be expressed by a color angle hab at a minimum density, namely $D_{min}$ and an optical density of 1.0. The color angle hab is obtained by using a color coordinates a*b* of space L*a*b* having approximately equal perceptional distance recommended by the CIE in 1976.

$$hab=\tan^{-1}(b^*/a^*)$$

As a result of study using the expression according to the above color angle, it is clear that the image tone of the photothermographic dry imaging material of this invention after development is preferably from 180° to 270°, more preferably from 200 to 270°, and most preferably from 220° to 260°, in the color angle hab. Such matter is also disclosed in JP-A 2002-6463.

It has been known that a diagnostic image exhibiting preferable appearance tone can be obtained by controlling u* and v* or a* and b* in the color space L*u*v* of CIE 1976 or the color space L*a*b* to specific values. Such matter is also described, for example, in JP-A 2000-29164.

On the other hand, it was found, as described in JP-A 2004-94240, that better parameters than those of typical wet processed silver salt photographic material can be given to the silver salt photothermographic dry imaging material by controlling the linear regression line into a specific range, the linear regression line is obtained by plotting the values of u*,v* or a*,b* at various photographic densities on a graph of the horizontal axis of u* or a* and the vertical axis of v* or b*. The preferable specific-condition range is described below.

(1) Determination coefficient (being multiple determination) $R^2$ of a linear regression line is preferably within the range of from 0.998 to 1.000, the linear regression line is obtained by plotting u* and v* values measured at each of densities of 0.5, 1.0 and 1.5, and the minimum density of the silver image obtained after thermal development treatment of the silver salt photothermographic dry imaging material on a two dimensional coordinate of the horizontal axis of u* and the vertical axis of v* of the color space L*u*v* based on CIE 1976. Moreover, it is preferable that the v* value at the crossing point the linear regression line and the vertical axis is from −5 to 5 and the slope of the line (v*/u*) is from 0.7 to 2.5.

(2) Determination coefficient (being multiple determination) $R^2$ of the linear regression line is preferably within the range of from 0.998 to 1.000, the linear regression line is obtained by plotting a* and b* values measured at each of densities of 0.5, 1.0 and 1.5, as well as the minimum density of the silver image obtained after thermal development treatment of the silver salt photothermographic dry imaging material on a two dimensional coordinate, of the horizontal axis of a* and the vertical axis of b* of the color space L*a*b* based on CIE 1976. Moreover, it is preferable that the b* value at the crossing point the linear regression line and the vertical axis is from −5 to 5 and the slope of the line (b*/a*) is from 0.7 to 2.5.

The procedure for determining the above linear regression line, namely an example of the method for measuring u*, v* and a*, b* in the color space based on CIE 1976, is described below.

A four-step wedge sample including unexposed area and areas each having an optical density of 0.5, 1.0 or 1.5 is prepared. Each of the density portions of thus prepared wedge is subjected to measurement by spectral colorimeter CM-36600d, manufactured by Minolta Co., Ltd., from which values of u*, v* and a*,b* are calculated. The measurement is carried out under conditions of a light source of F and a visual field angle of 10° in the transmission mode. Thus measured u*, v* or a*, b* are plotted on a graph with the horizontal axis of u* or a* and the vertical axis of v* or b*, through which points a linear regression line is drawn and then the determination coefficient (multiple determination) $R^2$, the intercept and the slope are determined.

A concrete method to obtain the linear regression line exhibiting the above characteristics is described below.

In this invention, suitable tone can be obtained by controlling the amount of compounds directly or indirectly involved in the course of the development process of the reducing agent (being a developing agent), of the silver halide particles, of the silver aliphatic carboxylate, and of the later-mentioned toning agent to optimize the shape of developed silver particles. For instance, the tone tends to be bluish when the shape of developed silver particle becomes dendrite-like and the tone tends to be yellowish when the shape becomes filament-like. The tone can be controlled considering such tendencies of the shape of developed silver particle.

As a toning agent, phthaladinone or phthalazine and phthalic acid and phthalic anhydride are usually employed. Suitable examples of the toning agent are disclosed in RD 17,029, U.S. Pat. Nos. 4,123,282, 3,994,732, 3,846,136 and 4,021,249.

Other than the above toning agents, the couplers described in JP-A 11-288057, European Patent No. 1,134,611A2 and the later-mentioned leuco dyes can also be used to control the tone.

As described above, the tone of the silver salt photothermographic dry imaging material can be controlled also by the leuco dye. The preferable leuco dye is a colorless or slightly colored compound capable of changing to a more colored state by oxidation when the compound is heated for 0.5 to 30 seconds at a temperature of from 80 to 200° C. Any leuco dye capable of forming a dye by oxidized by the oxidation product of the reducing agent can be used. The compounds exhibiting pH sensitivity and capable of changing to a colored state by oxidation are useful.

A leuco dye suitable to be used in this invention is not specifically limited, and for example, a biphenol leuco dye, a phenol leuco dye, an indoaniline leuco dye, an acrylated azine leuco dye, a phenoxadine leuco dye, a phenodiazine leuco dye and a phenothiadine leuco dye are appropriate. The leuco dyes described in the following publications are useful: U.S. Pat. Nos. 3,445,234, 3,846,136, 3,994,723, 4,021,349, 4,021,250, 4,022,617, 4,123,282, 4,368,247 and 4,461,681, JP-A Nos. 50-36110, 59-206831, JP-A 5-204087, 11-231460, 2002-169249 and 2002-236334.

To adjust the tone to a designated color, various color leuco dyes may preferably be used singly or in combinations of plural kinds thereof. To prevent variation of tone, particularly variations of a yellowish tone, which usually accompanies the using amount or ratio of the highly reactive reducing agent, and excessive reddening of image at high-density portion of not less than 2.0 caused by the use of fine silver halide particles, it is preferable to use a leuco dye forming a yellow color and that forming cyan color, and to control their used amount.

It is preferable that the image density is appropriately controlled by the relation of the tone of the developed silver itself. In this invention, it is preferable to control the tone so that the tone within the preferable range, regarding the image, at a reflective density of from 0.01 to 0.05 or a transmission density of from 0.005 to 0.50. In this invention, the used amount of the leuco dye is preferably controlled so that the total of the maximum density at the highest absorption wavelength of the dye image formed by the leuco dye preferably reaches 0.01 to 0.50, more preferably from 0.02 to 0.30, and particularly preferably from 0.03 to 0.10.

[Binder]

A binder may be contained in the photosensitive layer and the photo-insensitive layer of the silver salt photothermographic material for various purposes.

The binder to be contained in the photosensitive layer relating to this invention is one capable of suspending the organic silver salt, silver halide particles, reducing agent and other components. A suitable binder is transparent or semi-transparent and usually colorless. A natural polymer, a synthesized polymer and other film formable substances such as those described in JP-A 2001-330918, paragraph 0069, are applicable.

Of these, a polymer of an alkyl methacrylate, an aryl methacrylate and styrene are cited. Among such polymer compounds, ones each having an acetal group are preferably used. Among the polymer compounds having the acetal group, a poly(vinyl acetal) having an acetoacetal structure is more preferable, and the poly(vinyl acetal) compounds described in U.S. Pat. Nos. 2,358,836, 3,003,879 and 2,828,204, and British Patent No. 771,155 can be exemplified. The compounds having the acetal group represented by Formula V in JP-A 2002-287299 are particularly preferred.

The preferred binder for the photosensitive layer relating to this invention is a poly(vinyl acetal), and a poly(vinyl butyral) is particularly preferable which is preferably used as the primary binder. The primary binder is a binder accounting for not less than 50% of the entire binder of the photosensitive layer. Consequently, another binder may be blended within the range of less than 50%. Such polymer is not specifically limited as long as that is soluble in a solvent capable of dissolving the polymer of the invention. Preferable examples of the polymer include polyvinyl acetate, polyacrylic resin and urethane resin.

The glass transition point (Tg) of the binder to be used in this invention is preferably from 70 to 105° C., whereby sufficient maximum density can be obtained for image formation by the use of such a resin.

Number average molecular weight of the binder relating to this invention is from 1,000 to 1,000,000, preferably from 10,000 to 500,000, and polymerization degree of it is approximately from 50 to 1,000.

For the photo-insensitive layer such as an over-coating layer, subbing layer, particularly a protective layer and a back-coating layer, a cellulose ester particularly a polymer such as triacetyl cellulose or cellulose acetate butylate, is preferable. Two or more kinds of the above binders may be used in combination as appropriate.

Such binder is used within the range in which the resin effectively functions as a binder. An effective range is easily determined by someone skilled in the art. For instance, as an index in the case of the binder for suspending the organic silver salt in the photosensitive layer (image forming layer), the weight ratio of the binder to the organic silver salt is preferably 15:1-1:2, and particularly preferably from 8:1-1:1. Namely, the binder amount in the photosensitive layer is preferably from 1.5-6 g/m$^2$, and more preferably from 1.7-5 g/m$^2$. When the binder amount is less than 1.5 g/m$^2$, density of the unexposed area is considerably increased and sometimes becomes unacceptable for practical use.

An organic gelation agent may be integrated into the photosensitive layer. A gelation agent is a compound such as a poly-valent alcohol by addition of which a yield point is provided to an organic liquid and the fluidity of it is lowered or even extinguished.

It is also a preferable embodiment that the photosensitive layer coating liquid contains aqueous latex of a polymer. In such a case, the ratio of the aqueous polymer latex is preferably 50% or more by weight of the entire binder in the photosensitive layer coating liquid. When a polymer latex is used in the preparation of the photosensitive layer, it is preferable that the polymer derived from the polymer latex accounts for not less than 50%, and more preferably not less than 70%, by weight of the entire binder in the photosensitive layer.

Cross-linking Agent

A cross-linking agent may be added to the photosensitive layer relating to the invention, which can then link the binder molecules by a crosslinking bond. It has been known that the adhesion of the layer is improved and non-uniform development is reduced by the use of a cross-linking agent to the binder, and inhibited effects of fogging during storage and printout silver formation are also exhibited.

As a cross-linking agent, various cross-linking agents used for photographic materials, such as an aldehyde type, an epoxy type, an ethyleneimide type, a vinylsulfone type, a sulfonate type, an alkyloyl type, a carbodiimide type or a silane compound type are usable, and the following isocyanate type, silane compound type, epoxy compound type and acid anhydride are preferable.

The isocyanate type cross-linking agent is an isocyanate compound having at least two isocyanate groups and their adducts. Specifically, cited may be an aliphatic isocyanate, an aliphatic isocyanate having a cyclic group, a benzenediisocyanate, a naphthalenediisocyanate, a diphenylmethanediisocyanate, a triphenylmethanediisocyanate, a triisocyanate, tetraisocyanate, adducts of these isocyanates and adducts of these isocyanates with a di- or tri-valent polyalcohol. As specific examples, isocyanate compounds described in JP-A 56-5535, pp. 10-12 are applicable.

The adducts of the isocyanate compounds with the polyalcohol improves interlayer adhesion and displays high resistance to peeling of the layer, shifting of the image and occurrence of bubbles. Such isocyanate compounds may be added in any portion of the silver salt photothermographic dry imaging material. For example, the compound may be contained in an optional layer such as the support (specifically, in the case of support being paper, it may be incorporated in a sizing composition), the photosensitive layer, the surface protective layer, in an intermediate layer, in an anti-halation layer or in a subbing layer, further the compound may be added into one or more of the above layers.

Compounds each having a thioisocyanate structure corresponding to the above-described isocyanate compounds are also beneficial.

The amount of the cross-linking agent is usually from 0.001-2 moles, and preferably from 0.005-0.5 moles, per mole of silver.

The isocyanate and thioisocyanate compounds usable in the invention are preferably ones capable of functioning as a cross-linking agent, but compounds each having only one functional group also give acceptable results.

Examples of the silane compound include those represented by Formulas (1)-(3) disclosed in JP-A 2001-264930.

Epoxy compounds usable as the cross-linking agents are ones each having one epoxy group, and the number and molecular weight of the epoxy group are not specifically limited. The epoxy group is preferably included in the molecule as a glycidyl group through an ether bond or an imino bond. The epoxy compound may be any of a monomer, an oligomer or a polymer, and the number of the epoxy group is usually about 1-10, and preferably 2-4. When the epoxy compound is a polymer, the polymer may be either a homopolymer or a copolymer, and the particularly preferable range of the number average molecular weight Mn is approximately from 2,000 to 20,000.

The acid anhydride compounds to be used in this invention are compounds each having an acid anhydride group represented by the following structural formula. The compounds may be ones each having such an acid anhydride group and the number and molecular weight of the acid anhydride group are not specifically limited.

—CO—O—CO— Formula

The epoxy compounds and the acid anhydride compounds may be used solely or in combination of two or more kinds thereof. The adding amount of that is preferably from $1\times10^{-4}$ to $1\times10^{-2}$ moles/m$^2$, but more preferably from $1\times10^{-5}$ to $1\times10^{3}$ moles/m$^2$, though the amount is not specifically limited. The epoxy compound or the acid anhydride compound may be added as appropriate into any layer on the photosensitive layer side of the support such as the photosensitive layer, surface protective layer, an intermediate layer, the anti-halation layer or the subbing layer. The compound may be added into at least one of the above layers.

Silver Saving Agent

A silver saving agent may be contained in the photosensitive and the photo-insensitive layer relating to this invention. The silver saving agent is a compound by which the amount of silver necessary to form a targeted image density can be reduced.

Though various mechanisms can be considered as to how to reduce the silver amount, a compound having functioning to raise the covering power of developed silver is preferred. "Covering power" is the optical density per unit amount of silver. The silver saving agent may be contained in either the photosensitive layer or the photo-insensitive layer. Preferable example of the silver saving agent include a hydrazine derivative, a vinyl compound, a phenol derivative, a naphthol derivative, a quaternary onium compound and a silane compound. As specific examples, the silver saving agents disclosed in JP-A 2003-270755, paragraphs 0195 to 0235, may be cited.

Particularly preferable compounds as the silver saving agent relating to the invention are ones represented by the following Formula SE1 or SE2.

$Q_1$-NHNH-$Q_2$ Formula SE1

In the above Formula SE1, $Q_1$ is an aromatic group or a heterocyclic group each bonding to —NHNH-$Q_2$ at the carbon atom site, and Q2 is a carbamoyl group, an acyl group, an alkoxycarbonyl group, a sulfonyl group or a sulfamoyl group.

Formula SE2

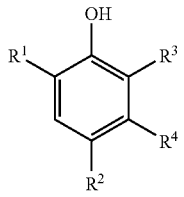

In the above Formula SE2, $R^1$ is an alkyl group, an acyl group, an acylamino group, a sulfonamide group, an alkoxycarbonyl group or a carbamoyl group. $R^2$ is a hydrogen atom, a halogen atom, an alkyl group, an alkoxy group, an aryloxy group, an alkylthio group, an arylthio group, an acyloxy group or a carbonate group. $R^3$ and $R^4$ are each a substituent capable of substituting to the benzene ring. $R^3$ and $R^4$ may form a condensed ring by bonding with together.

When $R^3$ and $R^4$ in Formula SE2 are bonded together to form a condensed ring, a naphthalene ring is particularly preferable as the condensed ring. When the compound of SE2 is a naphthol type compound, $R^1$ is preferably a carbamoyl group, and a benzoyl group is particularly preferable. $R^2$ is preferably an alkoxy group or an aryloxy group, of which the alkoxy group is particularly preferable.

Thermal Solvent

In the photothermographic dry imaging material of the present invention, a thermal solvent is preferably contained. "Thermal solvent" is a material by which the thermal developing temperature of the silver salt photothermographic dry imaging material can be lowered by not less than 1° C., preferably not less than 2° C., and more preferably not less than 3° C., compared to an imaging material without a thermal solvent. For instance, when image density resulting from photothermographic dry imaging material B, containing no thermal solvent, by exposing and thermally developed at 120° C. for 20 seconds can be obtained by the same exposure and developing time and a thermal developing temperature of not more than 119° C. on photothermographic dry imaging material A containing such a substance as the thermal solvent.

The thermal solvent incorporates a polar group as a substituent and is preferably that represented by Formula TS, but not limited to that.

$(Y)_nZ$ Formula TS

In Formula TS, Y may be an alkyl group, an alkenyl group, an alkynyl group, an aryl group or a heterocyclic group. Z may be a hydroxyl group, a carboxyl group, an amino group, an amido group, a sulfonamide group, a phosphoric amido group, a cyano group, an imido group, a ureido group, a sulfoxido group, a sulfono group, a phosphino group, a sulfoxido group or a heterocyclic group. "n" is an integer of from 1 to 3, and 1 when Z is a mono-valent group and when Z is 2 or more valent group, "n" is the same as the valent number of the Z group. When n is 2 or more, plural Z may be the same or differ.

Y may further have a substituent which may be the group represented by Z. Y is detailed below. In Formula TS, Y is a straight-, branched- or cyclic alkyl group preferably having from 1 to 40, more preferably from 1 to 30, and particularly from 1 to 25 carbon atoms, such as a methyl group, an ethyl group, an n-propyl group, an iso-propyl group, a sec-butyl group, a t-butyl group, a t-octyl group, an n-amyl group, a t-amyl group, an n-dodecyl group, an n-tridecyl group, an octadecyl group, an icocyl group, a dococyl group, a cyclopentyl group and a cylohexyl group; an alkenyl group preferably having from 2 to 40, more preferably from 2 to 30, and particularly from 2 to 25 carbon atoms, such as a vinyl group, an allyl group, a 2-butenyl group and a 3-pentenyl group; an acyl group preferably having from 6 to 40, more preferably from 6 to 30, and particularly from 6 to 25 atoms, such as a phenyl group, a p-methylphenyl group and a naphthyl group; or a heterocyclic group preferably having from 2 to 20, more preferably from 2 to 16, and particularly from 2 to 12 carbon atoms, such as a pyridyl group, a pyrazyl group, an imidazolyl group and a pyrrolidyl group. These substituents may be substituted for another substituent, and they may form a ring by bonding together.

Y may further have a substituent, examples of which are those described in JP-A 2004-21068, paragraph 0015. It is assumed that the reason of acceleration by the thermal solvent is that the thermal solvent is molten at a temperature near the developing temperature and fuses to the substances included in the development so as to enable development at a temperature lower than that without the thermal solvent. A reaction field having suitable polarity is preferably formed by the presence of the thermal solvent exhibiting a suitable polarity because the thermal development is a reducing reaction in which a carboxylic acid and a silver ion carrier, each having relatively high polarity, are included.

Melting point of the thermal solvent preferably used in the invention is from 50 to 200° C. but more preferably from 60 to 150° C. Particularly, a thermal solvent having a melting point of from 100 to 150° C. is preferable for the silver salt photothermographic dry imaging material, especially it is important when stability relating to external environmental conditions such as durability of image, which is an object of the invention.

Specific examples of the thermal solvent include the compounds described in JP-A 2004-21068, paragraph 0017, and MF-1 to MF-3, MF-6, MF-7, MF-9 to MF-12 and MF-15 to MF-22 described in US Patent Application Publication US 2002/0025498, paragraph 0027.

In this invention, the added amount of the thermal solvent is preferably from 0.01 to 5.0 g/m$^2$, more preferably from 0.05 to 2.5 g/m$^2$, and further preferably from 0.1 to 1.5 g/m$^2$. The thermal solvent is preferably contained in the photosensitive layer. The thermal solvent may be used solely or in combinations of two or more kinds of them. In this invention, the thermal solvent may be added to the coating liquid at any state such as the solution state, the emulsified state and the fine powdered solid state so as to be incorporated the photosensitive material.

In a well known emulsification method, the thermal solvent is dissolved employing an oil such as dibutyl phthalate, tricresyl phosphate, glyceryl triacetate and diethylphthalate, or an assistance solvent such as ethyl acetate and cyclohexanone, and is mechanically dispersed to form an emulsified dispersion.

As the finely powdered solid dispersion method, a method is applicable in which the thermal solvent is dispersed into a suitable medium, such as water, by a ball mill, colloid mill, vibration ball mill, sand mill, jet mill, roller mill or a device using ultrasonic waves. On the occasion of dispersion, a protective colloid such as polyvinyl alcohol, and a surfactant such as an anionic surfactant, for example, sodium triisopropylnaphthalenesulfonate (being a mixture of three compounds which differ from each other in the position of the iso-propyl group) may be used. Zirconia beads are usually used in the above mills, however zirconium, dissolved out from the beads, tends to mix with the dispersion components. The amount of zirconium is usually within the range of from 1 ppm to 1,000 ppm even though the amount varies depending on the dispersing condition. No problem is posed in practical use when the zirconium content is not more than 0.5 mg per gram of silver. An antiseptic such as sodium salt of benzoylthiazolinone is preferably added to the aqueous dispersion.

[Fog Inhibitor and Image Stabilizer]

It is preferable that a fog inhibiter for inhibiting occurrence of fogging during the storage before the thermal development and an image stabilizer for preventing the image deterioration after the development are preferably contained in any one of the layers constituting the silver salt photothermographic imaging material of the invention.

In the silver salt photothermographic imaging material of the invention, fog inhibitors and image stabilizers disclosed in various publications such as patent documents relating to dry imaging materials can be used.

Reducing agents having a proton such as bisphenols and sulfonamidophenols are principally used as the reducing agent relating to the invention. Therefore, a compound capable of preventing the reaction reducing silver ions by stabilizing the hydrogen and inactivating the reducing agent is preferably contained. A compound capable of oxidizing or bleaching silver atom or metallic silver (silver cluster) formed during the storage of the raw photographic material and the image is preferably contained.

Concrete examples of the compound having such the functions include biimidazolyl compounds, iodonium compounds and compounds capable of releasing a halogen atom as a labile species described in JP-A 2003-270755, paragraphs 0096 to 0128, polymers having at least one repeating unit of monomer capable of releasing a halogen radical disclosed in JP-A 2003-91054, vinylsulfones and/or β-halosulfones described in JP-A Hei 6-208192, and various fog inhibitors and image stabilizers such as vinyl type inhibitors having an electron withdrawing group.

[Toning Agent]

In the silver salt photothermographic imaging material of the invention, a photographic image is formed by the thermal developing treatment. Therefore, it is preferable that a toning agent for controlling the tone of silver image is contained in a state of dispersed usually in the organic binder.

Examples of the toning agent preferably used in the invention are disclosed in RD No. 17029, U.S. Pat. Nos. 4,123,282, 3,994,732, 3,946,136 and 4,021,249, such as those described below.

An imide compound such as succinimide, phthalimide and N-hydroxy-1,8-naphthalimide; a mercaptane such as 3-mercapto-1,2,4-triazole; a phthalazinone derivative and is metal salt such as phthalazinone, 4-(1-naphthyl)phthalazinone, 6-chlorophthalzinone, 5,7-dimetyloxyphthalazinone and 2,3-dihydro-1,4-phthalazinedione; a combination of phthalazine and a phthalic acid such as phthalic acid, 4-methylphthalic acid, 4-nitrophthalic acid and tetrachlorophthalic acid; and a combination of phthalazine, maleic anhydride and at least one compound selected from phthalic acid, 2,3-naphthalenedicarboxylic acid, an o-phenylenecarboxylic acid derivative and its derivative such as phthalic acid, 4-methylphthalic acid, 4-nitrophthalic acid and tetrachlorophthalic acid anhydride. Particularly preferable toning agent is a combination of phthalazinone or phthalazine and a phthalic acid or a phthalic anhydride.

[Fluorinated Type Surfactant]

A fluorinated type surfactant represented by the following Formula SF is preferably used for improving suitability of film conveying in a laser imager (thermal developing apparatus) and environment suitability (accumulation in organism).

$$(R_f\text{-}(L)_n\text{-})_p\text{-}(Y)_m\text{-}(A)_q \qquad \text{Formula SF}$$

In the above Formula SF, $R_f$ is a substituent containing a fluorine atom, L is a divalent linking group having no fluorine atom, Y is a (p+q)-valent linking group having no fluorine atom, A is an anion group or salt thereof, n and m are each an integer of 0 or 1, p is an integer of from 1 to 3 and q is an integer of from 1 to 3, provided that n and m are not 0 at the same time when q is 1.

In Formula SF, $R_1$ is a substituent containing a fluorine atom, for example a fluoroalkyl group having 1 to 25 carbon atoms such as trifluoromethyl group, trifluoroethyl group, perfluoroethyl group, perfluorobutyl group, perfluorooctyl group, perfluorododecyl group and perfluorooctadecyl group, or a fluoroalkenyl group such as perfluoropropenyl group, perfluorobutenyl group, perfluorononenyl group and perfluorodecenyl group. Number of carbon atoms of $R_f$ is preferably 2 to 8, and more preferably 2 to 6. Number of fluorine atom of $R_f$ is preferably 2 to 12, and more preferably 3 to 12.

L is a divalent linking group having no fluorine atom, for example, an alkylene group such as methylene group, ethylene group and butylene group, an alkyleneoxy group such as methyleneoxy group, ethyleneoxy group and butyleneoxy group, an oxyalkylene group such as oxymethylene group, oxyethylene group and oxybutylene group, an oxyalkyleneoxy group such as oxymethylenoxy group, oxyethyleneoxy group and oxyethylene-oxyethyleneoxy group, phenylene group, oxyphenylene group, phenyloxy group, oxyphenyloxy group, or a group constituted by combining the above groups.

A is an anion group, for example, a carboxylic group or its salt such as a sodium, potassium and lithium salt, a sulfonic group or its salt such as a sodium, potassium and lithium salt, a sulfate half ester group or its salt such as a sodium, potassium and lithium salt, or a phosphoric group or its salt such as a sodium, potassium and lithium salt.

Y is a (p+q)-valent linking group having no fluorine atom, for example, tri- or tetra-valent linking group with no fluorine atom constituted by a group of atoms having a central atom of nitrogen of carbon. n1 is an integer of 0 or 1 and 1 is preferred.

The fluorosurfactant represented by Formula FS can be obtained by the following procedure: An anionic group (A) is introduced, for instance, by sulfuric esterification reaction, to a compound (an alkanol compound partially bonded with $R_f$) prepared by addition reaction or condensation reaction of fluoroalkyl compound having 1 to 25 carbon atoms such as trifluoromethyl group, pentafluoroethyl group, perflyorobutyl group, perfluorooctyl group and perfluorooctadecyl group; an alkenyl group such as perfluorohexenyl group and perfluorononenyl group; a tri- to hexa-valent alkanol compound having no fluorine atom; and an aromatic compound or a heterocyclic compound each having 3 or 4 hydroxyl groups.

Examples of the above tri- to hexa-valent alkanol compound include glycerol, pentaerythrytol, 2-methyl-2-hydroxymethyl-1,3-propanediol,2,4-dihydroxy-3-hydroxymethylpentene, 1,2,6-hexanetriol, 1,1,1-tris-(hydroxylmethyl) propane 2,2-bis(butanol)-3, an aliphatic triol, tetremethylolmethane, D-sorbitol and D-mannitol.

Examples of the above aromatic or hetero compound having 3 or 4 hydroxyl groups include 1,3,5-trihydroxybenzene and 2,4,6-trihydroxypyridine.

Concrete preferable compounds of the fluorosurfactant represented by Formula SF are shown below.

SF-1

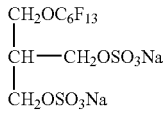

SF-2

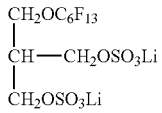

SF-3

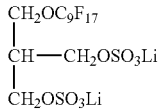

SF-4

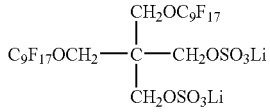

SF-5

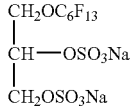

SF-6

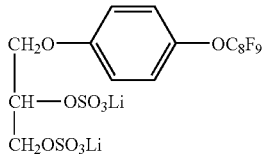

SF-7

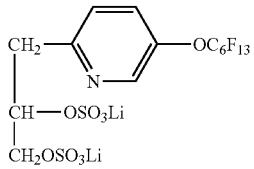

SF-8

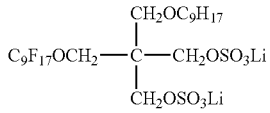

SF-9

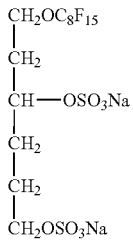

-continued

SF-10

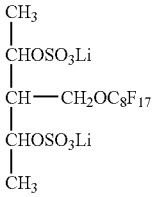

SF-11

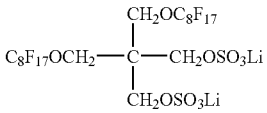

SF-12

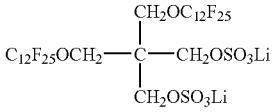

SF-13

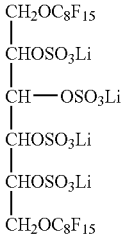

SF-14

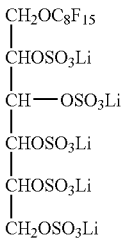

SF-15

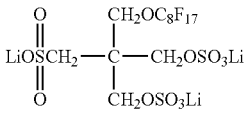

SF-16

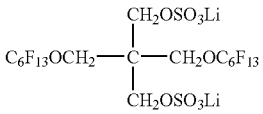

SF-17

$LiO_3S—C_3F_6—SO_3Li$

SF-18

$LiO_3S—C_4F_8—SO_3Li$

SF-19

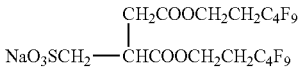

SF-20

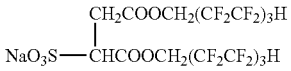

SF-21

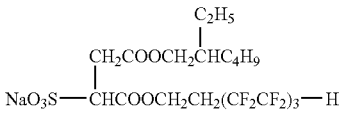

The fluorosurfactant represented by Formula SF can be added to the coating liquid by a commonly known method. Namely, the surfactant may be added in a state of being dissolved in an alcohol such as methanol and ethanol, a ketone such as methyl ethyl ketone and acetone, or a polar solvent such as dimethylsulfoxide and dimethylformamide. The fluorosurfactant may also be added in a state dispersed into fine particles of not more than 1 μm in water or an organic solvent by a sand mill, jet mill, ultrasonic waves or a homogenizer. Various techniques have been disclosed and the dispersion may be carried out based on such techniques. The fluorosurfactant represented by Formula SF is preferably added to the outermost protective layer.

The added amount of the fluorosurfactant represented by Formula SF is preferably from $1\times10^{-8}$ to $1\times10^{-1}$ moles, and particularly preferably from $1\times10^{-5}$ to $1\times10^{-2}$ moles, per square meter of the silver salt photothermographic dried imaging material. When the amount is less than in the above range, the anti-static effect can at times not be obtained, while when the amount exceeds the above range, humidity dependency tends at times to become excessive so as to degrade storage stability under high humidity.

[Surface Layer, and Surface Property Controlling Agent]

The silver salt photothermographic dry imaging material of this invention is frequently subjected to undesired influence caused by touching with various part of the apparatus or touching the surface with the rear surface of the imaging material in the course of winding, rewinding and/or conveying in the production processes such as coating, drying and cutting. For instance, scratches or sliding damages on the surface of the imaging material and degradation in the conveying suitability in the developing apparatus are caused.

Therefore, it is preferable that a sliding agent or a matting agent is added into any one of the layers, particularly in the outermost layer, of the silver salt photothermographic dry imaging material of this invention to control the surface properties so as to prevent damage to the surface and degradation in the conveying suitability.

In the silver salt photothermographic dry imaging material of this invention, friction reducing organic solid particles having an average diameter of from 1 μm to 30 μm are preferably contained in the outermost layer on the support and such particles are dispersed by a polymer dispersing agent. The melting point of the friction reducing organic solid particle is preferably higher than the thermal developing temperature and is not less than 80° C. and more preferably not less than 110° C.

The lubricating organic solid particles to be used in the silver salt photothermographic dry imaging material of this invention are preferably capable of lowering the surface energy, being such as crushed powder of polyethylene, polypropylene, polytetrafluoroethylene or a copolymer thereof.

Examples of the friction reducing organic solid particles composed of polyethylene or polypropylene are listed below, but this invention is not limited to them.

| | | Melting point (° C.) |
|---|---|---|
| PW-1 | Polytetrafluoroethylene | 321 |
| PW-2 | Propylene/ethylene copolymer | 142 |
| PW-3 | Polyethylene (Low density) | 113 |
| PW-4 | Polyethylene (High density) | 126 |
| PW-5 | Polypropylene | 145 |

In the silver salt photothermographic dry imaging material of this invention, compounds represented by following Formula 1 are preferably for the friction reducing organic solid particles.

$$(R_1)_p—X_1\text{-}L\text{-}X_2—(R_2)_q \qquad \text{Formula 1}$$

In Formula 1, $R_1$ and $R_2$ are each a substituted or unsubstituted alkyl group, an alkenyl group, an aralkyl group or an aryl group, each having 6 to 60 carbon atoms, plural $R_1$ and $R_2$ may be the same or differ when p or q is 2 or more. $X_1$ and $X_2$ are each a divalent linking group containing a nitrogen atom. L may be a substituted or unsubstituted (p+q)-valent alkyl group, alkenyl group, aralkyl group or aryl group.

In the silver salt photothermographic dry imaging material of this invention, it is preferable that at least one layer on the support contains the compound represented by Formula 1, a nonionic fluorosurfactant or an anionic fluorosurfactant.

The nonionic fluorosurfactants usable in this invention are preferably ones represented by following Formula A, though there is no specific limitation.

$$Rf_1—(AO)_n—Rf_2 \qquad \text{Formula A}$$

In the formula, $Rf_1$ and $Rf_2$ are each a fluorine-containing aliphatic group, which may be the same or differ. AO is a group containing at least one alkyleneoxy group, and n is an integer of from 1 to 30.

In the silver salt photothermographic dry imaging material of this invention, it is preferable to provide a filter layer on the photosensitive layer side or the rear side, or to add a dye or pigment into the photosensitive layer to control amount or wavelength distribution of light passing through the photosensitive layer.

As a dye, known compounds absorbing various and differing wavelength ranges can be used, corresponding to the spectral sensitivity of the photosensitive material.

When the silver salt photothermographic dry imaging material of this invention is infrared sensitive, a squarilium dye having a thiopyrylium nucleus (also called thiopyrylium squarilium dye), and that having a pyrylium nucleus (also called pyrylium squarilium dye), a thiopyrylium croconium dye similar to the squarilium dye and a pyrylium croconium dye, are preferable.

A compound featuring the squarilium nucleus is a compound having a 1-cyclobutene-2-hydroxy-4-one structure in the molecule, and a compound featuring the croconium nucleus is a compound having a 1-cyclopentene-2-hydroxy-4,5-dione in its molecule. In these compounds, the hydroxyl group may be dissociated. Further, the compounds described in JP-A 8-201959 are preferable as the dye.

[Support]

As the support material of the silver salt photothermographic dry imaging material of this invention, various polymer materials, glass, wool cloth, cotton cloth, paper, and metal such as aluminum, are usable. Among the above, ones capable of being a flexible sheet or roll are suitable from the viewpoint of handling capability of the information recording material. Consequently, plastic films such as cellulose acetate film, polyester film, poly(ethylene terephthalate) (PET) film, poly(ethylene naphthalate) (PEN) film, polyamide film, polyimide film, cellulose triacetate (TAC) film and polycarbonate (PC) film are preferable, of which biaxially stretched PET film is particularly preferred. Thickness of the support is typically from 50 to 300 μm, but preferably from 70 to 180 μm.

An electroconductive compound such as a metal oxide and/or an electroconductive polymer may be incorporated in the constituting layer to improve electrical properties. Such materials may be contained in any layer, and preferably in the backing layer, the surface protective layer on the photosensitive layer side or the subbing layer. The electroconductive materials described in U.S. Pat. No. 5,244,773, columns 14 to 20, are preferable. In this invention, it is preferable to add an electroconductive metal oxide into the surface protective layer of the backing layer.

An electroconductive metal oxide is a crystalline metal oxide particle, and ones containing an oxygen defect or a small amount of different atoms forming a donor for the metal oxide are particularly preferred since they generally display high electroconductivity, and the latter is particularly preferred since it does not cause fogging in the silver halide emulsion. Preferable examples of the metal oxide include ZnO, $TiO_2$, $SnO_2$, $Al_2O_3$, $In_2O_3$, $SiO_2$, MgO, BaO, $MoO_3$, $V_2O_3$ and composite oxides thereof, of which Zn, $TiO_2$ and $SnO_2$ are particularly preferred. For making an oxide containing a different atom, addition of Al or In to ZnO, that of Sb, Nb, P or a halogen element to $SnO_2$, and that of Nb or Ta to $TiO_2$ are particularly effective. The added amount of the different atom is preferably from 0.01 to 30 mol %, and particularly preferably from 0.1 to 10 mol %. A silicone compound may be added on the occasion of production of the micro-particle to improve the dispersibility and the transparency of the micro-particles.

The metal oxide micro-particle to be used in the silver salt photo-thermographic dry imaging material of this invention preferably have an electroconductivity, and volume resistivity of them is not more than $10^7$ Ω·cm, particularly not more than $10^5$ Ω·cm. These oxides are described in JP-A Nos. 56-143431, 56-120519 and 58-62647. An electroconductive material composed of the metal oxide adhering onto another crystalline metal oxide particles or a fiber-like substance such as titanium oxide is also appropriate, which are described in Examined Japanese Patent Application Publication No. (JP-B) 59-6235.

Functional particle size is preferably not more than 1 μm, and particles of not more than 0.5 μm are stable after dispersion and easily used. The use of the electroconductive particles of not more than 0.3 μm is specifically preferable to minimize light scattering so that a transparent photosensitive material can be produced. When the shape of the electroconductive particle is needle-like or fiber-like, preferable length thereof is not more than 30 μm and the diameter is not more than 1 μm, but more a preferable length is not more than 10 μm and the diameter is not more than 0.3 μm, and the ratio of length/diameter is preferably not less than 3. As $SnO_2$, NSN-10M, SN-100P, SN-100D and FSS-10M, are each marketed by Ishihara Sangyo Co., Ltd., and are appropriate.

[Layer Constitution]

The silver salt photothermographic dry imaging material of this invention carries at least one image forming layer on the support. A photo-insensitive layer is preferably provided on the photosensitive layer, though a sole photosensitive layer may be provided. For instance, a protective layer is preferably provided on the photosensitive layer to protect the photosensitive layer, and a backing coat layer may be provided on the opposite side of the support to prevent adhesion between photosensitive materials or as a roll of the photosensitive material.

For a binder to be used in the protective layer or the backing coat layer, a polymer exhibiting a glass transition point Tg higher than that of the photosensitive material and highly resistant to scratching or deformation are such as cellulose acetate, cellulose acetate butylate, of which cellulose acetate propionate is preferred among the foregoing polymers.

Two or more photosensitive layers on a side or one or more photosensitive layers on both sides of the support may be provided to control gradation.

[Coating of Constituting Layer]

The silver salt photothermographic dry imaging material of this invention is preferably produced by preparing separate coating liquids for each of the constituting layers by dissolving or dispersing the materials of each of the layers and simultaneously coating of the plural coating liquids to form a multicoated layer which are subjected to heating treatment after the coating. "Simultaneously coating of plural coating liquids" means that plural layers are simultaneously coated to form a multicoated layer and dried, the plural layers are not formed by repeating separate coating and drying of each of the coating liquids. Namely, the upper layer is provided onto the lower layer before the remaining amount of solvent in the lower layer becomes not more than 70%, but more preferably not more than 90% by weight.

The method for simultaneously coating the constituting layers is not specifically limited and known methods such as a bar coating method, a curtain coating method, a dipping method, an air-knife method, a hopper coating method, a reverse roller coating method, a gravure coating method, a slide coating method and an extrusion coating method can be applicable.

Of the above methods, the slide coating method and the extrusion coating method are preferred. Though the coating methods are described as to the coating onto the photosensitive layer side, the same method may be applied for simultaneously coating the backing coat layer together with an under coating layer. The simultaneous coating of the silver salt photothermographic dry imaging material is further described in detail in JP-A 2000-15173.

In this invention, the appropriate coating amount of silver is determined based on the purpose of the silver salt photothermographic dry imaging material, and is preferably from 0.3 g/m$^2$ to 1.5 g/m$^2$, and more preferably from 0.5 g/m$^2$ to 1.5 g/m$^2$ for medical imaging purposes. The silver derived from the silver halide preferably accounts for from 2 to 18%, but more preferably from 5 to 15%, of the total amount of coated silver.

In this invention, the coating density of silver halide particle of not less than 0.01 μm in the sphere corresponding diameter is preferably from $1\times10^{14}$ to $1\times10^{18}$ particles/m$^2$, and more preferably from $1\times10^{15}$ to $1\times10^{17}$ particles/m$^2$.

Coating density of the photo-insensitive silver long-chain aliphatic carboxylate is preferably from $1\times10^{-17}$ g to $1\times10^{-14}$ g, and more preferably from $1\times10^{-16}$ g to $1\times10^{-15}$ g, per silver halide particle of not less than 0.01 μm in sphere corresponding diameter.

When coating is carried out under conditions within the above range, preferable results, from the viewpoint of the covering power of silver can be obtained, the maximum density of the silver image per unit amount of coated silver, and the visual tone of the silver image.

In this invention, it is preferable that the silver salt photothermographic dry imaging material contains solvents in an amount of from 5 to 1,000 mg/m$^2$, at the time of the development. The solvent amount is more preferably from 10 to 150 mg/m$^2$. Under such conditions, a silver salt photothermographic dry imaging material of high sensitivity, low fogging and high density can be produced. As such solvent, those described in JP-A 2001-264930, paragraph [0030], are appricable but the solvent is not limited to those, and may be used solely or in combination of plural kinds.

The content of the solvent in the silver salt photothermographic dry imaging material can be controlled by changing the temperature conditions during the drying process after coating. The content of the solvent can be measured by gas chromatography under suitable conditions. for detecting the solvent contained in the material.

[Odor and Contamination Prevention Techniques]

Preferable embodiments of techniques for reducing or preventing odor and contamination caused by volatilization of low molecular weight substances from the material, in the thermal developing apparatus such as a laser imager, are described below.

The silver salt photothermographic dry imaging material of the invention preferably has a function to prevent volatilization or adhesion of contamination substance formed in the period of thermal development. For such purposes, the binder of the protective layer is preferably cellulose acetate having an acetylated degree of from 50% to 70% or a polymer having a poly(vinyl alcohol) unit with a saponification degree of not more than 75%. The lowest limit of the saponification degree is preferably 40% and more preferably 60%.

In the protective layer, the above polymer can be mixed with other polymers such as those described in U.S. Pat. Nos. 6,353,819, 6,352,820 and 6,350,562. The ratio by volume of such polymer is preferably from 0 to 90%, and more preferably from 0 to 40%.

Preferable for cross-linking agent of the above binders are an isocyanate type compound, a silane type compound, an epoxy type compound and an acid anhydride.

It is further preferable to reduce the volatilizable substances from the photosensitive material by using an acid capturing agent. As the acid capturing agent, isocyanate type compounds represented by following Formula X-1, epoxy type compounds represented by Formula X-2, phenol type compounds represented by Formula X-3 and amine type and carbodiimide type compounds represented by Formula X-4 can be cited.

Formula X-1

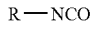

Formula X-2

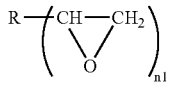

Formula X-3

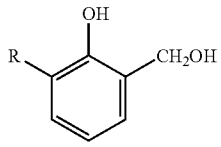

Formula X-4

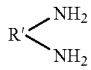

In the above Formulas X-1 to X-4, R is a substituent and R' is a divalent linking group, and n1 is an integer of from 1-4.

[Exposure Conditions]

Various conditions relating to the light source and exposure time suitable to obtain a good image can be applied for light exposing to the silver salt photothermographic dry imaging material and the image forming method of this invention.

In this invention, a suitable light source for the spectral sensitivity of the photosensitive material is of course preferable. When the photosensitive material is infrared sensitive, an infrared semiconductor laser (780 nm or 820 nm) is preferably used since such laser can generate high power so that the silver salt photothermographic dry imaging material can become transparent, even though the material is applicable for any light source in the infrared region.

The silver salt photothermographic dry imaging material of this invention displays such characteristics when the material is exposed to high luminance light of not less than 1 $mW/mm^2$ for a short time, which luminance results in an optical density of 3.0 on the photosensitive material. The light amount (intensity×exposure time) can be reduced by applying a high enough luminance and such a highly sensitive system can be designed. The light amount is preferably from 2 $mW/mm^2$ to 50 $mW/mm^2$ and more preferably from 10 $mW/mm^2$ to 50 $mW/mm^2$.

Though any light source can be used as long as it satisfies the above conditions, which can be fully satisfied by a laser light source. Preferable lasers include a gas laser ($Ar^+$, $Kr^+$ of He—Ne), a YAG laser, a dye laser and a semiconductor laser. A combination of a semiconductor laser and a secondary harmonics generating element may also be applied. A semiconductor laser, generating blue or purple light at an intensity peak within the wavelength range of from 350 nm to 440 nm is applicable. As a high-power outputting blue or purple light laser, NLHV 3000E, being a semiconductor laser, is cited.

In this invention, exposure is preferably carried out by scanning of the laser, and various methods can be applied for such exposing procedure. As the first preferable method, a method using a laser scanning exposing apparatus can be cited, in which the angle of the scanning laser beam to the surface of the photosensitive material to be exposed is basically not made to vertical.

Here, "basically not made to vertical" means that the angle nearest vertical during the laser scanning is preferably from 55 to 88°, more preferably 60 to 86°, further preferably from 65 to 84°, and most preferably from 70 to 82° C.

When photosensitive material is scanned by laser light, the maximum diameter of the beam spot on the photosensitive material surface is preferably not more than 200 μm and more preferably not more than 100 μm. The smaller spot diameter is preferable because shifting of the incidence angle from vertical angle can be reduced, and the lowest limit of the beam spot diameter is 10 μm. Degradation of image quality related to reflected light such as occurrence of interference fringe-like unevenness can be reduced by applying such laser scanning exposure.

As the second method, exposure using a laser scanning exposing apparatus is preferable, in which laser light is generated in a multiple vertical mode. Degradation in image quality caused by occurrence of interference fringe-like unevenness is thereby reduced compared to scanning by a single vertical mode light. To create the multiple vertical mode, methods employing wave synthesizing, utilizing returned light and applying high frequency waves are suitable. Multiple vertical mode means that the wavelength of exposure light is not single and distribution of wavelength of exposure light is preferably not less than 5 nm and more preferably not less than 10 nm. There is theoretical no upper limit to the wavelength distribution, which is approximately 60 nm.

As the third embodiment, image formation by scattered exposure using two or more laser light beams is also appropriate. The image recording method using plural beams of laser light is a technique used in a laser printed or a digital recording machine for writing plural lines in one scanning according to demand of high resolution or high speed and is disclosed for example in JP-A 60-166916. In this method, laser beams irradiated from a light unit are modulated by a polygon mirror and focused on the photosensitive material through an fθ lens; the apparatus for such a method is a laser scanning optical apparatus basically the same as a laser imager.

In the image writing means of a laser printer or digital copying machine, the second laser beam is focused at a point displaced by a space of one line from the focusing point of the first beam for printing plural line images at once. In concrete, the two light beams are individually focused at a distance on the order of of several 10 μm from each other and the pitch in the sub-scanning direction is 63.5 μm in an image printing density of 400 dpi, dpi being the number of dots per inch or 2.54 μm, and 42.3 μm in an image printing density of 600 dpi. In this invention, it is preferable that the two laser beams are focused at the same point on the exposing surface at an incident angle differing from the above method in which the focusing point is displaced by one dissolving space. In such a case, it is preferable that the exposing energy satisfies a relationship of $0.9\times E \leqq En\times N \leqq 1.1\times E$, wherein E is exposing energy when the exposure is carried out by a usual single laser beam (at a wavelength of λ nm), and N beams of laser light are the same in the wavelength λ nm and in energy En. Energy at the exposing surface can be maintained by satisfying such the condition, and reflection of each of the laser beams to the image forming layer is reduced since the exposing energy of each of the beams is low, so that the interference fringes can be inhibited.

In the above case, wavelength of the plural laser beams is the same as λ. However, beams differing in wavelength from each other may also be used. In such case, the wavelength is preferably within the range of $(\lambda-30)<\lambda_1, \lambda_2, \ldots \lambda_n \leqq (\lambda+30)$.

In the above first, second and third embodiments, employed may be well known solid lasers such as a ruby laser, YAG laser and glass laser; gas lasers such as a He—Ne laser, Ar ion laser, Kr ion laser, $CO_2$ laser, CO laser, He—Cd laser, $N_2$ laser and excimer laser; semiconductor lasers such as InGaP laser, AlGaAs laser, GaAsP laser, InGaAs laser, InAsP laser, $CdSnP_2$ laser and GaSb laser; chemical lasers and dye lasers can be optimally selected for use according to purpose. Of these, laser beams at a wavelength of from 600 to 1200 nm irradiated by the semiconductor laser are preferable from the viewpoint of maintenance and overall size of the light source. In a laser imager or laser image setter, spot diameter of the laser beam on the exposing surface of the silver salt photothermographic material to be scanned is usually from 5 to 75 μm in the minor axis and from 5 to 100 μm in the major axis. The scanning rate of the laser light beam is suitably determined for individual silver salt photothermographic dry imaging materials according to the particular sensitivity of the photothermographic material at the wavelength of light oscillated from the laser, and the power of the laser.

[Laser Imager and Developing Condition]

The laser imager (also known as a thermal developing apparatus) relating to this invention is constituted of a film supplying means such as a film tray, a laser image recording means, a thermal developing means for stably and uniformly applying heat to the entire surface of the silver salt photothermographic dry imaging material, and a conveying means to convey the silver salt photothermographic dry imaging material from the film supplying means to the output portion through the laser image recording portion and the thermal developing means by which an image is formed on the imaging material.

Distance between the position of exposing treatment and that of thermal developing treatment is preferably shortened for more rapid processing. Further, it is preferable that the exposing treatment simultaneously progresses with the thermal developing treatment. Namely, a part of a sheet of silver salt photothermographic dry imaging material is imagewise exposed to light and the thermal development of the sheet is started the same time at another part of the sheet. To perform such processes, distance between the exposing position and the developing position is preferably from 0 cm to 50 cm. By such a constitution, the time necessary to perform a series of treatments of exposing and development can be considerably shortened. The preferable range of the distance is from 3 cm to 40 cm and more preferably from 5 cm to 30 cm.

Here, the exposing position is a position where the light from the light source is irradiated onto the silver salt photothermographic dry imaging material, and the developing position is a position where the silver salt photothermographic dry imaging material is initially heated for thermally development.

Conveying rate of the silver salt photothermographic dry imaging material at the developing position is from 20 to 200 mm/second, and particularly preferably from 30 to 150 mm/second. A conveying rate within such range is preferable for improved uniformity of development and of image production for emergency diagnosis.

Development of the silver salt photothermographic dry imaging material is typically carried out by heating an image-wise exposed photothermographic dry imaging material at an appropriately high temperature, and the developing conditions vary depending on the machine, apparatus or means being used. Development is commonly carried out at a temperature of from about 80 to 200° C., preferably from about 100 to 140° C., and more preferably from 110 to 130° C., and preferably for a duration of from 3 to 20 seconds, and more preferably from 5 to 12 seconds.

A heating treatment, for development of the silver salt photothermographic dry imaging material of this invention, is preferably conducted by contacting the surface of the material on which the protective layer is provided, from the viewpoint of uniformity of heating, conservation of heat and ease of operation. It is preferred that the silver salt photothermographic dry imaging material is conveyed while contacting the protective layer surface of the material is in contact with a heated roller for thermal development.

It is preferable that an image, produced by thermally developing the silver salt photothermographic dry imaging material of the invention at 123° C. for 12 seconds, results in an average gradation in the range of an diffuse optical density of from 0.25 to 2.5 being from 2.0 to 4.0 on a characteristic curve drawn on a rectangular coordinate system having the Y-axis as the diffuse density and the X-axis as the logarithm of the exposure amount, each graduated at the same unit of length. An image, which is high in diagnostic perception capability while low in the amount of used silver, can be obtained when the gradation of the image is within the above range.

EXAMPLES

This invention is described in detail below referring to examples, but the invention is not limited to these examples. In the examples, "percent" means "percent by weight" as long as specific description is not attached.

<<Synthesis of Polymers A, B, C and Comparative Polymer for Dispersing Silver Halide Particles>>

A dripping device, thermometer, nitrogen gas inlet pipe, stirrer and reflux condenser were attached to a 0.5 liter four-mouth separable flask, and 50 g of methyl ethyl ketone and monomers other than NIPAM at the ratio in grams described in Table 1 were charged into the flask and heated at the temperature described in Table 1. Then a solution of NIPA monomer, in the amount of grams described in Table 1, dissolved in 43 g of methyl ethyl ketone containing 0.12 g of lauryl peroxide was dripped into the flask over 2 hours. The reacting liquid was heated by spending 1 hour. At the time when reflection was begun, a solution of 0.17 g of lauryl peroxide dissolved in 33 g of methyl ethyl ketone (MEK) was dripped into the flask over 2 hours and further allowed to react for 3 hours at the same temperature. After that, a solution of 0.33 g of methylhydroquinone dissolved in 107 g of methyl ethyl ketone was added to the reacting liquid and cooled. Thus, solutions each containing 30% by weight of Polymers A, B and C and a comparative polymer, respectively, were obtained. The molecular weights of the polymers were determined as weight average molecular weight in terms of polystyrene by GPC. In Table 1, PME-400 is Blemmer PME-400 [Methacrylate having $-(EO)_m-CH_3$ (where m is about 9)], PSE-400 is Blemmer PSE-400 [Methacrylate having $-(EO)_m-C_{18}H_{37}$ (where m is about 9)], each manufactured by Nihon Yushi Co., Ltd., NIPAM is N-isopropylacrylamide manufactured by Kojin Co., Ltd., and DAAM is Diacetoneacrylamide manufactured by Kyowa Hakkou Co., Ltd. In the above "EO" is an ethyleneoxy group.

TABLE 1

| Monomer component | Polymer A g | Polymer B g | Polymer C g | Comparative Polymer D g |
|---|---|---|---|---|
| DAAM | 20 | 35 | 29 | 8 |
| PSE-400 | 20 | 4 | 8 | 12 |
| PME-400 | 20 | 26 | 31 | 38 |
| NIPAM | 40 | 35 | 32 | 42 |
| Reacting temperature | 75° C. | 77° C. | 77° C. | 77° C. |
| logP | 0.97 | 0.83 | 0.93 | 0.70 |
| Molecular weight | 50,000 to 70,000 | 20,000 to 50,000 | 20,000 to 50,000 | 10,000 to 30,000 |

<<Preparation of Silver Halide Emulsion>>

[Preparation of Silver Halide Emulsion 1]

| | |
|---|---|
| (Solution A1) | |
| Phthalated gelatin (at a phthalated ratio of 99% or more) | 66.25 g |
| Compound*1 (a 10% methanol solution) | 10 ml |
| Potassium bromide | 0.32 g |
| Water to make | 5,429 ml |
| (Solution B1) | |
| 0.67 moles/L silver nitrate solution | 2,635 ml |

-continued

| | |
|---|---|
| (Solution C1) | |
| Potassium bromide | 51.55 g |
| Potassium iodide | 1.47 g |
| Water to make | 660 ml |
| (Solution D1) | |
| Potassium bromide | 154.9 g |
| Potassium iodide | 4.41 g |
| $K_3IrCl_6$ (at an amount corresponding to $4 \times 10^{-5}$ mol/Ag) | 50.0 ml |
| Water to make | 1,982 ml |
| (Solution E1) | |
| 0.4 moles/L potassium bromide solution at an amount necessary for maintaining the silver electrode potential | |
| (Solution F1) | |
| Potassium hydroxide | 0.71 g |
| Water to make | 20 ml |
| (Solution G1) | |
| 56% Acetic acid aqueous solution | 18.0 ml |
| (Solution H1) | |
| Sodium carbonate anhydride | 1.72 g |
| Water to make | 151 ml |

*[1]Compound A: $HO(CH_2CH_2O)_n(CH(CH_3)CH_2O)_{17}(CH_2CH_2O)_mH$ (m + n = 5 to 7)

To Solution A1, a fourth of Solution B1 and all of Solution C1 were added by a double-jet mixing method over 4 minutes and 45 seconds using a mixing stirrer described in JP-B 58-58288, to form nuclei. After 1 minute, all of Solution F1 was added. During the above processing, pAg was suitably controlled by using Solution E1. After passing 6 minutes, three fourths of Solution B1 and all of Solution D1 were added by a double-jet method over 14 minutes and 15 seconds while controlling pAg at 8.09. After 5 minutes of stirring, all of Solution G1 was added to precipitate the emulsion. The supernatant was removed to remain 2,000 ml of the precipitate part, and then 10 liters of water was added and the precipitate was re-precipitated after stirring. The supernatant was removed to remain 1,500 ml of precipitate part and Solution H1 was added. Then the liquid was heated to 60° C. and further stirred for 120 minutes. Finally, pH was adjusted to 5.8 and water was added so that the weight became 495 g per mole of silver to prepare the targeted silver halide emulsion.

The silver halide particles of the thus obtained silver halide emulsion 1 were monodispersed cubic iodobromide particles exhibiting a sphere corresponding diameter of 0.060 μm, a variation coefficient of the sphere corresponding diameter of 12% and a [100] face ratio of 92%. The sphere corresponding diameter and its variation coefficient were determined as an average value of the result obtained from 1,000 random particles by an electron micrometer. The ratio of [100] faces was determined by the Kubelka-Munk method.

The ratio of particles exhibiting an average particle diameter of from 0.001 μm to 0.050 μm in the silver halide emulsion 1 was 61% of the weight of all silver halide particles in terms of silver.

[Preparation of Silver Halide Emulsions 2 to 4, dispersed in MEK]

Into 330 g of water, 33 g of the solution of Polymer A was dripped after which the solvent was removed to take out the solid polymer. The solid polymer was dissolved by adding 67 g of methanol and stirred for 30 minutes at 45° C. To the resultant solution, 25 g of silver halide emulsion 1 adjusted to 45° C. was dripped over 1 minute and further stirred for 60 minutes to obtain silver halide emulsion a. Silver halide emulsions b and c and comparative silver halide emulsion d were each prepared in the same manner as in silver halide emulsion a except that the solutions of polymer A was replaced by polymers B and C and comparative polymer D, respectively.

[Precipitation and Separation of Silver Halide Particle Dispersion]

Silver halide particle dispersion a was cooled to the temperature cited in Table 2 and stirred for 30 minutes and further allowed to stand for 30 minutes. In this situation, it was confirmed that the solid component was precipitated and possible to be separated, if appropriate. Ninety five grams of the separated supernatant was removed to obtain precipitate 1. Precipitates b and c and comparative precipitate d were prepared in the same manner as in precipitate a except that the solution of silver halide emulsion a was replaced by the solutions of silver halide emulsions b, c and comparative silver halide emulsion d, respectively.

The supernatant was weighed after removing the solvent to confirm the solid ingredients contained in the supernatant. Results are listed in Table 2.

TABLE 2

| Silver halide dispersion | Cooling temperature [° C.] | Solid content in supernatant (%) | Remarks |
|---|---|---|---|
| a | 18 | 15 | Inventive |
| b | 18 | 10 | Inventive |
| c | 25 | 8 | Inventive |
| Comparative polymer d | 18 | 25 | Comparative |

To precipitate 1, 235 g of methyl ethyl ketone (MEK) was added and vacuum distilled until the moisture content of the liquid reached less than 10%. Finally, methyl ethyl ketone was added so as to bring the total weight of the liquid to 157 g, whereby polymer dispersed silver halide emulsion 1 was obtained. Silver halide particle emulsions dispersed in MEK 2, 3 and 4 were prepared in the same manner as above except that precipitates 2, 3 and 4 were used instead of precipitate 1.

<<Preparation of Organic Silver Salt A Powder>>

[Preparation of Powder of Organic Silver Salt A containing Silver Halide Particles]

In 4,720 ml of purified water, 130.8 g of behenic acid, 67.7 g of arachidic acid, 43.6 g of stearic acid and 2.3 g of palmitic acid were dissolved at 80° C. To the resultant solution, 540.2 ml of a 1.5 moles/L aqueous solution of potassium hydroxide was added and 6.9 g of concentrated nitric acid was further added and the liquid was cooled to 55° C. to obtain a solution of potassium fatty acid salt. To the potassium fatty acid salt solution, 45.3 g of the above photosensitive silver halide particle emulsion and 450 ml of purified water were added and stirred for 5 minutes while maintaining a liquid temperature of 45° C.

After that, 702.6 ml of a 1 mole/L silver nitrate solution was added over 2 minutes while stirring and stirred for another 10 minutes to obtain an organic silver salt dispersion. The thus obtained organic silver salt dispersion was transported to a washing vessel, and deionized water was added. The liquid was stirred and allowed to stand and any floating organic silver salt dispersion was separated, and solid water-soluble salts were removed from the bottom of the liquid. The separated organic silver salt dispersion was repeatedly washed by exchanging deionized water until the electroconductivity of the used water became 20 μS/cm, and the dispersion was dewatered by centrifuge. The thus obtained cake of organic silver salt was dried in a nitrogen gas atmosphere employing a gas stream drying machine, namely a Flash Dryer, manufactured by Seishin Kigyo Co., Ltd., until moisture content become 0.1% under conditions of 65° C. at the entrance and 40° C. at the exit of the drying machine. The thus dried organic silver salt powder A was obtained. An infrared aquameter was used for measuring the moisture content of the organic silver salt composition.

Organic silver salt particles were prepared by using commercially available behenic acid. According to the result of analysis of the above behenic acid, by a method to be described later, content of the behenic acid was 80% by weight and the remaining ingredients were arachidic acid, and stearic acid. Therefore, 130.8 g of behenic acid, 67.7 g of arachidic acid 43.6 g of palmitic acid and 2.3 g, of each being a reagent class chemical, were mixed and poured into 4,720 ml purified water and dissolved at 80° C. To the resultant solution, 540.2 ml of a 1.5 moles/L aqueous solution of sodium hydroxide was added and 6.9 g of concentrated nitric acid was further added, and the liquid was cooled to 55° C. to obtain a solution of sodium fatty acid salt. The following processes were totally carried out in a dark place, 45.3 g of the above photosensitive silver halide particle emulsion and 450 ml of purified water were added to the sodium fatty acid salt solution and stirred for 5 minutes while maintaining a liquid temperature of 45° C. After that, 702.6 ml of a 1 mole/L silver nitrate solution was added over 2 minutes and stirred for 10 minutes to obtain an organic silver salt dispersion. Thus organic silver salt A-1 containing silver halide particle was obtained. Resultant organic silver salt dispersion A was transported to a washing vessel where deionized water was added. The liquid was stirred and allowed to stand to float the organic silver salt, and water-soluble salts were removed from the bottom of the liquid. The separated organic silver salt dispersion was repeatedly washed by exchanging deionized water until the electroconductivity of the exhausted water reached 20 μS/cm, and the dispersion was dewatered by centrifuge to obtain a cake of silver halide particle-containing organic silver salt A, of which cake of silver halide particle-containing organic silver salt A was dried in a nitrogen gas atmosphere until the moisture content became to 0.1% by weight using a fluid layer dryer, namely Midget Dryer MDF-64 manufactured by Dalton Co., Ltd., while controlling the temperature at the entrance of the drying machine to obtain silver halide particle-containing organic silver salt A. The moisture content of silver halide particle-containing organic silver salt A was measured by an infrared aquameter. As a result of measuring of the content of behenic acid in silver halide particle-containing organic silver salt A by a to be later-mentioned method, the ratio of behenic acid contained in silver halide particle-containing organic silver salt A was 54% by weight. According to results of the analysis of the organic acids after mixing, the heavy metal content and the iodine value thereof were each 5 ppm and 1.5, respectively.

(Analysis Method for Organic Acid)

Behenic acid content was determined by the following method. About 10 mg of the organic silver salt was precisely weighed and charged into a 200 ml eggplant type flask. To the flask, 15 ml of methanol and 3 ml of a 4 moles/L hydrochloric acid were further added and the contents of the flask were dispersed by ultrasonic waves for 1 minute. Several Teflon® boiling stones were added to the dispersion and the dispersion was refluxed over 60 minutes. After cooling the dispersion, 5 ml of methanol was poured into the cooled reacted liquid through the cooling tube to wash off any matter adhering to the cooling tube of the flask. This washing was repeated one more time. Thus obtained reacting liquid was twice subjected to extraction by adding 100 ml of ethyl acetate and 70 ml of water. The extracted substance was dried under vacuum for 30 minutes. One milliliter of a benzanthrone solution was charged into a 10 ml measuring flask as an internal reference. The sample was dissolved in toluene and charged into the flask, after which the volume of the contents of the flask was adjusted to 10 ml with toluene. The solution was subjected to gas chromatography and mole-percent of each of the organic acids was determined from the peak area of each of the acids. Thereby composition of all the organic acids was determined.

Next, the amounts of free organic acids not forming silver salt were measured. About 20 mg of organic silver salt sample was exactly weighed and dispersed by ultrasonic waves after addition of 10 ml of methanol. The resultant liquid was filtered and the filtrate was dried to obtain extracted free organic acids. The composition of the free organic acids and the ratio of them in all the organic acids could be known by measuring by gas chromatography in the same manner as in the analysis of the total organic acid. The composition of the organic acids in the state of silver salt was defined by the different between the amount of the whole organic acids and that of the free organic acids.

[Preparation of Organic Silver Salt Powder B with no Silver Halide Particle]

Organic silver salt powder B containing no silver halide particle was prepared in the same manner as in the above silver halide particle-containing organic silver salt power A except that silver halide particle emulsion 1 was replaced by the same amount of water. A content of silver behenate in the organic silver salt powder B with no silver halide particle was 55% by weight.

<<Preparation of Organic Silver Salt Dispersion A>>

In 1,300 g of methyl ethyl ketone, 49 g of polyvinyl butyral, S-LEC B•BL-SHP manufactured by Sekisui Co., Ltd., was dissolved and 500 g of organic silver salt powder A was gradually added while stirring by a dissolver, Dispermat CA-40M manufactured by VMA-Getzmann Co., Ltd., and sufficiently stirred to prepare a preliminary dispersion. After addition of the whole of organic silver salt powder A, the dispersion was further stirred for 15 minutes at 1,500 rpm. The preliminary dispersion was supplied by a pump into a media type dispersing machine, Dispermat SL-C12EX manufactured by VMA-Getzmann Co., Ltd., and dispersed at a circumference rate of 9 m/s to prepare organic silver salt dispersion A. A solid component concentration in thus prepared organic silver salt dispersion was about 27%.

<<Preparation of Organic Silver Salt Dispersion B>>

Organic silver salt dispersion B was prepared in the same manner as in organic silver salt dispersion B except that organic silver salt powder A was replaced by organic silver salt powder B with no silver halide particles.

[Preparation of Subbed Support]

The both sides of two-axis stretched poly(ethylene terephthalate) having a blue density of 0.135 were subjected to corona treatment of $10W/m^2 \cdot min$. On one side of the film, the following coating liquid of lower layer of the subbing layer for backing layer side was coated so that the dry layer thickness was 0.06 μm and dried at 140° C. and the following coating liquid of upper layer of the subbing layer for backing layer side was coated so that the dry layer thickness was 0.2 μm and dried at 140° C. On the opposite side, the following coating liquid of lower layer of the subbing layer for photosensitive layer side was coated so that the dry layer thickness was 0.06 μm and dried at 140° C. and the following coating liquid of upper layer of the subbing layer for photosensitive layer side was coated so that the dry layer thickness was 0.2 μm and dried at 140° C. Thus subbed support was prepared.

<<Coating Liquid of Lower Layer of Subbing Layer for Backing Layer Side>>

| | |
|---|---|
| Copolymer latex of Styrene/Glycidyl dimethacrylate/Butyl acrylate (20/20/40) (Solid content: 30%) | 16.0 g |
| Copolymer latex of Styrene/Butyl acrylate/Hydroxymethyl methacrylate (25/45/30) (Solid content: 30%) | 4.0 g |
| $SnO_2$ sol (Solid content: 10%) synthesized by the method described in JP-A Hei 10-059720 | 91 g |
| Surfactant A | 0.5 g |
| Water to make | 1,000 ml |

<<Coating Liquid of Upper Layer of Subbing Layer for Backing Layer Side>>

| | |
|---|---|
| Modified hydrophilic polyester A (Solid content: 18%) | 215.0 g |
| Surfactant A | 0.4 g |
| True spherical silica matting agent, Seahostar KE-P50 manufactured by Nihon Shokubai Co., Ltd. | 0.3 g |
| Water to make | 1000 ml |

<<Synthesis of Modified Hydrophilic Polyester A>>

Into a polymerization vessel, 35.4 parts by weight of dimethyl terephthalate, 33.63 parts by weight of dimethyl isophthalate, 17.92 parts by weight of sodium salt of dimethyl 5-sulfo-isophthalate, 62 parts by weight of ethylene glycol, 0.065 parts by weight of calcium acetate monohydrate and 0.022 parts by weight of manganese acetate tetrahydrate were charged and ester exchanging reaction was performed at 170 to 220° C. under nitrogen gas stream while distilling out methanol. After that, 0.04 parts by weight of trimethyl phosphate, 0.04 parts by weight of antimony trioxide as a polycondensation catalyst and 6.8 parts by weight of 1,4-cyclohexane carboxylic acid were added and esterification reaction was carried out at a reaction temperature of 220 to 235° C. while removing a theoretical amount of water. In the reaction system, the pressure was reduced and the temperature was raised over one hour and the polycondensation was performed for 1 hour at 280° C. and less than 133 Pa to obtain a precursor of modified hydrophilic polyester A. Inherent viscosity of the precursor was 0.33.

Into a tree-mouth flask with a stirring wing, reflux cooler and thermometer, 850 ml of purified water was charged and 150 g of the above precursor was gradually added while rotating the stirring wing. The reacting system was stirred for 30 minutes at room temperature, and the heated over 1.5 hours so that the interior temperature was raised by 98° C. The system was held at this temperature for 3 hours to dissolve the precursor. After completion of the heating, the resultant liquid was cooled by room temperature over 1 hour and stood for one night. Thus a solution of the precursor having a solid concentration of 15% by weight was prepared.

Into a 3L four-mouth flask on which a stirrer, reflux cooler, thermometer and dropping funnel, 1900 ml of the above precursor solution and heated by 80° C. while stirring. Into the resultant liquid, 6.52 ml of a 24% aqueous solution of ammonium peroxide was added and a mixture liquid of monomers composed of 28.5 g of glycidyl methacrylate, 21.4 g of ethyl acrylate and 21.4 g of methyl methacrylate was dropped for 30 minutes. After that the liquid was cooled by less than 30° C. and filtered. Thus a solution of modified hydrophilic polyester A having a solid concentration of 18% was prepared.

<<Coating Liquid of Lower Layer of Subbing Layer for Photosensitive Layer Side>>

| | |
|---|---|
| Copolymer latex of styrene/acetoacetoxyethyl methacrylate/glycidyl methacrylate/n-butyl acrylate (40/40/20/0.5) (Solid content: 30%) | 70 g |
| Surfactant A | 0.3 g |
| Water to make | 1000 ml |

Surfactant A

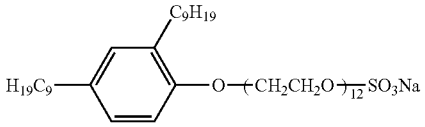

<<Coating Liquid of Upper Layer of Subbing Layer for Photosensitive Layer Side>>

| | |
|---|---|
| Modified hydrophilic polyester B (Solid content: 18%) | 80.0 g |
| Surfactant A | 0.4 g |
| True spherical silica matting agent, Seahostar KE-P50 manufactured by Nihon Shokubai | 0.3 g |
| Water to make | 1000 ml |

The solid concentration in the coating liquid was 0.5%.

<<Synthesis of Modified Hydrophilic Polyester B>>

A solution of modified hydrophilic polyester B was prepared in the same manner as in modified hydrophilic polyester A except that the composition of the monomer mixture was changed to 31 g of styrene, 31 g of cetocetoxyethyl methacrylate, 61 g of glycidyl methacrylate and 7.6 g of n-butyl acrylate.

<<Preparation of Coated Samples 101 to 105>>

Coated Samples 101 to 105 of silver salt photothermographic material were prepared by the following procedure.

<<Preparation of Surface Protective Layer Coating Liquid>>

| | |
|---|---|
| Methyl ethyl ketone | 1056 g |
| Cellulose acetate propionate (CAP141-20 manufactured by Eastman Chemical Co., Ltd.) | 148 g |
| Poly(methyl acrylate) (Paraloid A21, manufactured by Rohm & Haas Co., Ltd.) | 6 g |
| Matting agent dispersion (Silica having a dispersing degree of 10%, an average size of 4 μm and a solid concentration of 1.7%) | 170 g |

-continued

| | |
|---|---|
| $CH_2{=}CHSO_2CH_2CH(OH)CH_2SO_2CH{=}CH_2$ | 3.6 g |
| Benzimidazole | 2 g |
| $C_9F_{17}O(CH_2CH_2O)_{23}C_9F_{17}$ | 5.4 g |
| $LiO_3S{-}CF_2CF_2CF_2{-}SO_3Li$ | 0.12 g |

<<Backing Layer>>

| | |
|---|---|
| Methyl ethyl ketone | 1350 g |
| Cellulose acetate propionate (CAP141-20 manufactured by Eastman Chemical Co., Ltd.) | 121 g |
| Dye A | 0.23 g |
| Dye B | 0.62 g |
| Fluorinated acryl copolymer (Optfron FM450 manufactured by Daikin Kogyn Co., Ltd.) | 1.21 g |
| Amorphous saturated copolymerized polyester (Vylon 240P manufactured by Toyo Boseki Co., Ltd.) | 18.1 g |
| Matting agent dispersion | Mentioned below |
| $C_9F_{17}O(CH_2CH_2O)_{23}C_9F_{17}$ | 5.21 g |
| $LiO_3S{-}CF_2CF_2CF_2{-}SO_3Li$ | 0.81 g |

Matting agent dispersion: To 90 g of MEK dissolving 2 g of a polymer dispersing agent, 2 g of an organic friction reducing particle was added, and the mixture was dispersed by a ultrasonic dispersing apparatus, Ultrasonic Generator manufactured by Alex Corp., at a frequency 25 kHz and 600 W for 30 minutes.

Dye A

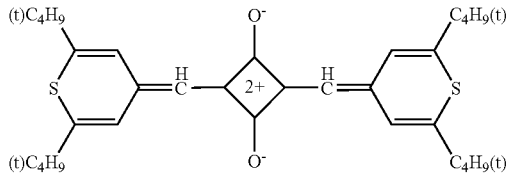

Dye B

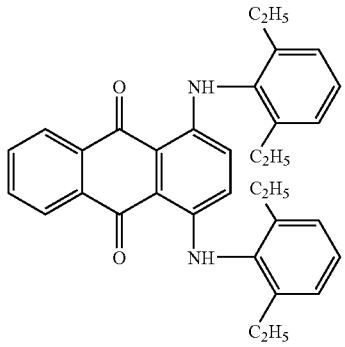

Dispersing agent: Cellulose acetate propionate CAP (CAP 482-20 manufactured by Eastman Chemical Co., Ltd.), Poly(vinyl btiral) PVB (S-Lec B•BL-SHP, manufactured by Sekisui Kagaku Kogyo Co., Ltd.), Polyester (Vylon 240P, manufactured by Toto Boseki)

<<Preparation of Photosensitive Layer Coating Liquid>>

(Preparation of Photosensitive Emulsion 1)

To 1670 g of the above organic silver salt dispersion A, the same amount of methyl ethyl ketone was added and held at 18° C. while stirring and 12.6 g of bis(mimethylacetoamido)-dibromobromate (11% solution) was added and stirred for 1 hour. After that, 20.1 g of calcium bromide was added and stirred for 30 minutes. A stabilizer solution and an infrared sensitizing dye were add and stirred for 1 hour and then the liquid was cooled by 13° C. and further stirred for 30 minutes. To the liquid, 416 g of poly(vinyl butyral) resin powder, S-Lec B•BL-5 manufactured by Sekisui Kagaku Kogyo Co., Ltd, was added and dissolved while holding at 13° C. After confirmation of completion of dissolution, 19.8 g of tetrachlorophthalic acid (13% methyl ethyl ketone solution) was added and the following additives were added at intervals of 15 minutes while continuing stir to prepare photosensitive emulsion 1 for coating the photosensitive layer.

| | |
|---|---|
| Phtharazine | 12.4 g |
| Desmodur N3300 (aliphatic isocyanate manufactured by Morvey Co., LLd.) | 17.6 g |
| Fog preventing solution | Mentioned below |
| Developing agent solution | Mentioned below |

<Preparation of Infrared Sensitizing Dye Solution>

In 135 g of methyl ethyl ketone, 300 mg of the following infrared sensitizing dye 1,400 mg of the following infrared sensitizing dye 2, 130 g of 5-methyl-2-mercaptobenzimidazole, 21.5 g of 2-chloro-benzoic acid, 2.5 g of the following dye dissolving agent were dissolved to prepare an infrared sensitizing dye.

<Preparation of Stabilizing Agent Solution>

In 14 g of methanol, 0.9 g of the following stabilizing agent and 0.3 g of potassium acetate were dissolved to prepare the stabilizing agent solution.

(Preparation of Developing Agent Solution)

In methyl ethyl ketone, 120 g of the developing agent and 9 g of 4-methylphthalic acid were dissolved and the solution was made up to 1200 g to prepare the developing agent solution.

Infrared sensitizing dye 1

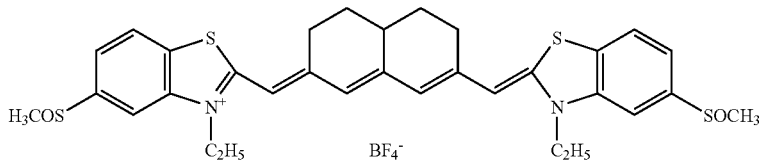

-continued

Infrared sensitizing dye 2

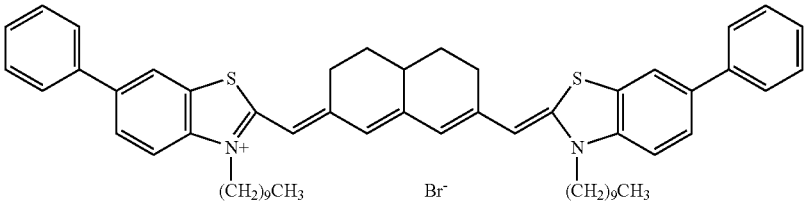

Sensitizing dye dissolving agent

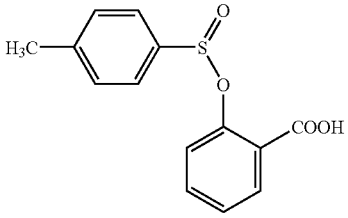

Stabilizing agent

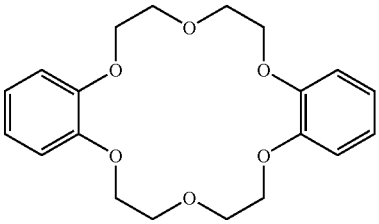

Developing agent

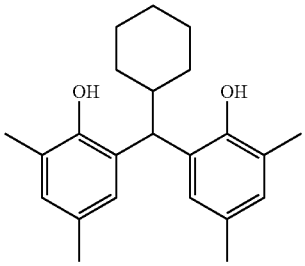

(Preparation of Photosensitive Emulsions 2, 3 and 4)

To 1690 g of the above organic silver salt dispersion B, 1080 g of methyl ethyl ketone was added and stirred while holding at 18° C. and 157 g of the foregoing EMK-dispersed silver halide particle 1 was added and stirred for 30 minutes. After that, 12.6 g of bis(dimethylacetoamido)dibromobromate (11% methanol solution) was added and stirred for 1 hour, and then 20.1 g of calcium bromide (11% methanol solution) was added and stirred for 30 minutes. Moreover, the stabilizing agent solution and the infrared sensitizing dye solution were added and stirred for 1 hour, and then the temperature of the liquid was lowered by 13° C. and stirred for 30 minutes. In the resultant liquid held at 13° C., 416 g of poly(vinyl butyral) powder, S-Lec B•BL-5 manufactured by Sekisui Kagaku Kogyo Co., Ltd., was added and dissolved. After confirmation of completion of dissolution, 19.8 g of tetrachlorophthalic acid (13% methyl ethyl ketone solution) was added and the following additives were added at intervals of 15 minutes while continuing stir to prepare photosensitive emulsion 2 for coating the photosensitive layer.

Photosensitive emulsions 3, 4 and 5 were each prepared in the same manner as in Photosensitive emulsion 2 except that the MEK-dispersed silver halide particle emulsion was replaced by MEK-dispersed silver halide emulsions 2, 3 and 4, respectively.

| | |
|---|---|
| Phtharazine | 12.4 g |
| Desmodur N3300 (aliphatic isocyanate manufactured by Morvey Co., Ltd.) | 17.6 g |

-continued

| | |
|---|---|
| Fog preventing solution | Mentioned above |
| Developing agent solution | Mentioned above |

<<Preparation of Sample 101>>

[Coating of Photosensitive Layer, Surface Protective Layer and Backing Layer]

On the subbing layer of photosensitive layer side of the subbed support, photosensitive layer coating liquid 1 and the surface protective layer coating liquid were simultaneously coated so that the total silver amount was 1.6 g/$^2$ and the wet coated amount of the protective layer was 23 g/m$^2$. Continuously, the backing layer coating liquid was coated on the backing side subbing layer so that the wet coated amount was 4.2 g/m$^2$. The drying was each carried out at 60° C. for 15 minutes. The sample coated on both sides was treated at 79° C. for 10 minutes while conveyed to obtain a silver salt photothermographic dry imaging material. Thus Sample 101 was prepared.

<<Preparation of Samples 102 to 105>>

Samples 102 to 105 were each prepared in the same manner as in Sample 101 except that photosensitive layer coating liquids 2 to 5 were used in place of photosensitive layer coating liquid 1.

<<Evaluation of Silver Salt Photothermographic Dry Imaging Material>>

The above prepared Samples 101 to 105 were subjected to evaluation by the following methods.

[Exposure and Development]

Each of the above samples was exposed on the side of the photosensitive layer coated side by scanning of the laser beam through an optical wedge using an exposing apparatus having the light source of a semiconductor laser in vertical multiple mode by high frequency overlapping of light of wavelength of 800 to 820 nm. Angle of the laser light beam with the exposure surface of the sample for forming the image was 75°. In such case, a good image showing lower ununiformity and higher resolution than exception compared with those of the image obtained when the angle was set at 90° C.

After that, the sample was developed by an automatic developing apparatus having a heating drum and a cooling zone in which the protective layer of the sample was touched with the drum surface. The exposure and development were carried out in a room conditioned at 25° C. and 50% of RH.

[Measurement of Sensitivity, Fog Density and Maximum Density]

Optical density of thus obtained a silver image of wedge was measured by a densitometer and a characteristic curve was drawn on a graph having the vertical axis of density and the horizontal axis of logarithm of exposure amount (Log E).

Reciprocal of the exposure amount necessary for forming a density higher by 1.0 than the fog density was determined as the sensitivity. The minimum density (fog density) and the maximum density were also measured. The sensitivity and the maximum density were each expressed by relative values when those of Sample 101 were each set at 100. The results are listed in Table 3.

[Evaluation of Dispersed State in Coated Layer]

Regarding each of the coated samples, dispersion degree of the photosensitive silver halide emulsion having a particle diameter of from 0.005 μm to 0.1 μm measured in the direction of exposure by the foregoing method was evaluated by visually observing the image taken by a transmission electron microscope TEM according to the following procedure.

A ultra thin slice of the sample having a thickness of from 0.1 to 0.2 μm was prepared by using an diamond knife, and the sliced sample was held by a copper mesh and moved onto a carbon layer made hydrophilic by glow discharge. The sliced sample was observed in light visual field by the TEM at a magnification of from 5,000 to 40,000 and quickly recorded by a CCD camera. The acceleration voltage of the TEM was 150 kV. The recorded TEM image was visually observed for evaluating the dispersing situation. The results are listed in Table 3.

[Evaluation of Humidity Dependency]

Samples 101 through 105 were conditioned at 23° C. and 80% of RH for 3 days and exposed and developed by the foregoing methods. The fog of the samples was measured for evaluating the humidity dependency. The results are listed in Table 3.

TABLE 3

| | | Organic silver salt powder | | | Evaluation result | | | | | |
|---|---|---|---|---|---|---|---|---|---|---|
| Sample | Dispersing polymer Kind | Kind | Behenic acid content (mole-%) | Photo-sensitive emulsion Kind | *1 | Dmin | Sensi-tivity | Maximum density | Dmin after condi-tioning | Remarks |
| 101 | — | A | 43 | 1 | B | 0.20 | 100 | 3.2 | 0.23 | Comparative |
| 102 | A | B | 43 | 2 | A | 0.18 | 110 | 3.5 | 0.18 | Inventive |
| 103 | B | B | 43 | 3 | A | 0.17 | 120 | 3.6 | 0.17 | Inventive |
| 104 | C | B | 43 | 4 | A | 0.18 | 107 | 3.4 | 0.18 | Inventive |
| 105 | D | B | 43 | 5 | C | 0.21 | 70 | 2.8 | 0.25 | Comparative |

*1: Dispersed situation in layer

As is cleared by the results listed in Table 3, the silver salt photothermographic materials of the invention are lower in the fog than that of the comparative example even though the sensitivity and the maximum density are the same or higher and are smaller in the humidity influence. It is understood that images suitable for diagnosis can be obtained by the samples.

What is claimed is:

1. A method for separating photosensitive silver halide particles by precipitation from a dispersion comprising the silver halide particles and a protective colloid of a natural polymer, the method comprising the step of:

mixing the dispersion with an organic polymer having a logarithm value of n-octanol/water partition coefficient (being a log P value) of 0.8 to 2.0 so as to separate the silver halide particles from the dispersion by precipitation.

2. The method for separating by precipitation of claim 1, wherein the method further comprising the step of: controlling a temperature of the dispersion after mixed with the organic polymer to 15-30° C.

3. The method for separating by precipitation of claim 1, wherein a solid content of a supernatant liquid of the separated system is not more than 15% of the entire solid components of the dispersion.

4. A precipitate obtained by the method described in claim 1.

5. A photosensitive emulsion produced by mixing an organic solvent with a photosensitive silver halide particle dispersion obtained by dispersing the precipitate described in claim 4 into an organic solvent having a water content of not more than 10%.

6. A silver salt photothermographic dry imaging material comprising a support and a photosensitive layer containing the photosensitive emulsion described in claim 5 provided on the support.

* * * * *